US007252147B2

(12) United States Patent
Badalamenti et al.

(10) Patent No.: US 7,252,147 B2
(45) Date of Patent: Aug. 7, 2007

(54) CEMENTING METHODS AND SYSTEMS FOR INITIATING FLUID FLOW WITH REDUCED PUMPING PRESSURE

(75) Inventors: Anthony M. Badalamenti, Katy, TX (US); Karl W. Blanchard, Cypress, TX (US); Simon Turton, Kingwood, TX (US); Ronald R. Faul, Katy, TX (US); Henry E. Rogers, Duncan, OK (US); James E. Griffith, Loco, OK (US); Michael G. Crowder, Orlando, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 161 days.

(21) Appl. No.: 10/896,492

(22) Filed: Jul. 22, 2004

(65) Prior Publication Data

US 2006/0016599 A1 Jan. 26, 2006

(51) Int. Cl.
*E21B 34/12* (2006.01)

(52) U.S. Cl. ..... 166/285; 166/177.4

(58) Field of Classification Search ..... 166/285, 166/292, 177.4

See application file for complete search history.

(56) References Cited

U.S. PATENT DOCUMENTS 2,223,509 A 12/1940 Brauer
2,230,589 A 2/1941 Driscoll (Continued)

FOREIGN PATENT DOCUMENTS

EP 0 419 281 A2 3/1991

(Continued)

OTHER PUBLICATIONS

Foreign Communication From a Related Counter Part Application, Sept. 30, 2005.

(Continued)

*Primary Examiner*—William Neuder
(74) *Attorney, Agent, or Firm*—John W. Wustenberg; Baker Botts, L.L.P.

(57) ABSTRACT

A method of initiating fluid circulation in a well bore through a casing inner diameter and an annulus outside the casing, the method having the following steps: inducing an increase in the annulus fluid pressure; flowing cement composition into the annulus at the top of the well bore; maintaining a difference in pressure between the fluid pressure of the casing inner diameter and the fluid pressure of the annulus until enough cement composition has entered the annulus to drive fluid circulation by the added cement composition weight. A method of cementing a casing in a well bore, wherein an annulus is defined between the casing and the well bore, the method having the following steps: connecting a circulation fluid pump to the casing inner diameter; pumping circulation fluid out of the casing inner diameter, whereby fluid flow in a reverse-circulation direction through the casing inner diameter and annulus is initiated; maintaining fluid flow in a reverse-circulation direction through a well bore annulus and the casing inner diameter until enough cement composition has entered the annulus to drive fluid circulation by the added cement composition weight; disconnecting the low-pressure cement composition pump from the annulus; and flowing additional cement composition into the annulus to complete a cement composition operation.

60 Claims, 13 Drawing Sheets

U.S. PATENT DOCUMENTS

| | | | | |
|---|---|---|---|---|
| 2,407,010 | A | 9/1946 | Hudson | |
| 2,472,466 | A | 6/1949 | Counts et al. | |
| 2,647,727 | A | 8/1953 | Edwards | 255/28 |
| 2,675,082 | A | 4/1954 | Hall | 166/22 |
| 2,849,213 | A | 8/1958 | Failing | |
| 2,919,709 | A | 1/1960 | Schwegman | 137/68 |
| 3,051,246 | A | 8/1962 | Clark, Jr. et al. | 166/226 |
| 3,193,010 | A | 7/1965 | Bielstien | |
| 3,277,962 | A | 10/1966 | Flickinger et al. | 166/15 |
| 3,948,322 | A | 4/1976 | Baker | 166/289 |
| 3,948,588 | A | 4/1976 | Curington et al. | |
| 3,951,208 | A | 4/1976 | Delano | 166/78 |
| 4,105,069 | A | 8/1978 | Baker | 166/51 |
| 4,271,916 | A | 6/1981 | Williams | |
| 4,300,633 | A * | 11/1981 | Stewart | 166/250.14 |
| RE31,190 | E | 3/1983 | Detroit et al. | 166/293 |
| 4,469,174 | A | 9/1984 | Freeman | |
| 4,519,452 | A | 5/1985 | Tsao et al. | |
| 4,531,583 | A | 7/1985 | Revett | 166/253 |
| 4,548,271 | A | 10/1985 | Keller | 166/291 |
| 4,555,269 | A | 11/1985 | Rao et al. | 525/130 |
| 4,671,356 | A | 6/1987 | Barker et al. | |
| 4,676,832 | A | 6/1987 | Childs et al. | 106/730 |
| 4,791,988 | A | 12/1988 | Trevillion | |
| 4,961,465 | A | 10/1990 | Brandell | |
| 5,024,273 | A | 6/1991 | Coone et al. | 166/289 |
| 5,117,910 | A | 6/1992 | Brandell et al. | |
| 5,125,455 | A | 6/1992 | Harris et al. | |
| 5,133,409 | A | 7/1992 | Bour et al. | 166/293 |
| 5,147,565 | A | 9/1992 | Bour et al. | 252/8.551 |
| 5,188,176 | A | 2/1993 | Carpenter | 166/285 |
| 5,213,161 | A | 5/1993 | King et al. | |
| 5,273,112 | A | 12/1993 | Schultz | |
| 5,297,634 | A | 3/1994 | Loughlin | 166/387 |
| 5,318,118 | A | 6/1994 | Duell | |
| 5,323,858 | A | 6/1994 | Jones et al. | |
| 5,361,842 | A | 11/1994 | Hale et al. | |
| 5,484,019 | A | 1/1996 | Griffith | |
| 5,494,107 | A * | 2/1996 | Bode | 166/285 |
| 5,507,345 | A | 4/1996 | Wehunt, Jr. et al. | 166/285 |
| 5,559,086 | A | 9/1996 | Dewprashad et al. | |
| 5,571,281 | A | 11/1996 | Allen | |
| 5,577,865 | A | 11/1996 | Manrique et al. | |
| 5,641,021 | A | 6/1997 | Murray et al. | |
| 5,647,434 | A | 7/1997 | Sullaway et al. | |
| 5,671,809 | A | 9/1997 | McKinzie | |
| 5,718,292 | A | 2/1998 | Heathman et al. | |
| 5,738,171 | A | 4/1998 | Szarka | |
| 5,749,418 | A | 5/1998 | Mehta et al. | |
| 5,762,139 | A | 6/1998 | Sullaway et al. | 166/291 |
| 5,803,168 | A | 9/1998 | Lormand et al. | |
| 5,829,526 | A | 11/1998 | Rogers et al. | |
| 5,875,844 | A | 3/1999 | Chatterji et al. | |
| 5,890,538 | A * | 4/1999 | Beirute et al. | 166/285 |
| 5,897,699 | A | 4/1999 | Chatterji et al. | 106/678 |
| 5,900,053 | A | 5/1999 | Brothers et al. | |
| 5,913,364 | A | 6/1999 | Sweatman | |
| 5,968,255 | A | 10/1999 | Mehta et al. | |
| 5,972,103 | A | 10/1999 | Mehta et al. | |
| 6,060,434 | A | 5/2000 | Sweatman et al. | |
| 6,063,738 | A | 5/2000 | Chatterji et al. | 507/269 |
| 6,098,710 | A | 8/2000 | Rhein-Knudsen et al. | 166/285 |
| 6,138,759 | A | 10/2000 | Chatterji et al. | 166/293 |
| 6,143,069 | A | 11/2000 | Brothers et al. | |
| 6,167,967 | B1 | 1/2001 | Sweatman | |
| 6,196,311 | B1 | 3/2001 | Treece et al. | 166/192 |
| 6,204,214 | B1 | 3/2001 | Singh et al. | |
| 6,244,342 | B1 | 6/2001 | Sullaway et al. | 166/285 |
| 6,258,757 | B1 | 7/2001 | Sweatman et al. | |
| 6,311,775 | B1 | 11/2001 | Allamon et al. | 166/285 |
| 6,318,472 | B1 | 11/2001 | Rogers et al. | |
| 6,367,550 | B1 | 4/2002 | Chatterji et al. | 166/293 |
| 6,431,282 | B1 | 8/2002 | Bosma et al. | |
| 6,454,001 | B1 | 9/2002 | Thompson et al. | |
| 6,457,524 | B1 | 10/2002 | Roddy | |
| 6,467,546 | B2 | 10/2002 | Allamon et al. | 166/381 |
| 6,481,494 | B1 | 11/2002 | Dusterhoft et al. | 166/51 |
| 6,484,804 | B2 | 11/2002 | Allamon et al. | 166/291 |
| 6,488,088 | B1 | 12/2002 | Kohli et al. | 166/285 |
| 6,488,089 | B1 | 12/2002 | Bour et al. | |
| 6,488,763 | B2 | 12/2002 | Brothers et al. | |
| 6,540,022 | B2 | 4/2003 | Dusterhoft et al. | 166/278 |
| 6,622,798 | B1 | 9/2003 | Rogers et al. | |
| 6,666,266 | B2 | 12/2003 | Starr et al. | |
| 6,732,797 | B1 | 5/2004 | Watters et al. | 166/291 |
| 6,758,281 | B2 | 7/2004 | Sullaway et al. | |
| 6,802,374 | B2 | 10/2004 | Edgar et al. | 166/285 |
| 6,808,024 | B2 | 10/2004 | Schwendemann et al. | |
| 6,810,958 | B2 | 11/2004 | Szarka et al. | |
| 2003/0000704 | A1 | 1/2003 | Reynolds | 166/312 |
| 2003/0029611 | A1 | 2/2003 | Owens | 166/250.03 |
| 2003/0072208 | A1 | 4/2003 | Rondeau et al. | |
| 2003/0192695 | A1 | 10/2003 | Dillenbeck et al. | 166/285 |
| 2004/0079553 | A1 | 4/2004 | Livingstone | 175/61 |
| 2004/0084182 | A1 | 5/2004 | Edgar et al. | 166/285 |
| 2004/0099413 | A1 | 5/2004 | Arceneaux | 166/173 |
| 2004/0104050 | A1 | 6/2004 | Järvelä et al. | 175/57 |
| 2004/0104052 | A1 | 6/2004 | Livingstone | 175/61 |
| 2004/0177962 | A1 | 9/2004 | Bour | 166/285 |
| 2004/0231846 | A1 * | 11/2004 | Griffith et al. | 166/291 |
| 2005/0061546 | A1 | 3/2005 | Hannegan | 175/7 |
| 2006/0016600 | A1 | 1/2006 | Badalamenti et al. | |
| 2006/0042798 | A1 * | 3/2006 | Badalamenti et al. | 166/285 |
| 2006/0086499 | A1 * | 4/2006 | Badalamenti et al. | 166/250.14 |
| 2006/0086502 | A1 | 4/2006 | Reddy et al. | |
| 2006/0086503 | A1 * | 4/2006 | Reddy et al. | 166/293 |
| 2006/0131018 | A1 | 6/2006 | Rogers et al. | |

FOREIGN PATENT DOCUMENTS

| | | | |
|---|---|---|---|
| GB | 2193741 | | 2/1988 |
| GB | 2327442 | A | 1/1999 |
| GB | 2348828 | A | 10/2000 |
| RU | 1716096 | A1 | 2/1992 |
| RU | 1723309 | A1 | 3/1992 |
| RU | 1774986 | | 11/1992 |
| RU | 1778274 | | 11/1992 |
| RU | 1542143 | C | 12/1994 |
| RU | 2067158 | | 9/1996 |
| RU | 2 086 752 | C1 | 8/1997 |
| SU | 571584 | | 9/1977 |
| SU | 1420139 | A1 | 8/1988 |
| SU | 1534183 | | 1/1990 |
| SU | 1758211 | A1 | 8/1992 |
| WO | WO 2004/104366 | | 12/2004 |
| WO | WO 2005/083229 | A1 | 9/2005 |
| WO | WO 2006/008490 | A1 | 1/2006 |
| WO | WO 2006/064184 | A1 | 6/2006 |

OTHER PUBLICATIONS

Foreign Communication From a Related Counter Part Application, Dec. 7, 2005.

Halliburton Brochure Entitled "Bentonite (Halliburton Gel) Viscosifier", 1999.

Halliburton Brochure Entitled "Cal-Seal 60 Cement Accelerator", 1999.

Halliburton Brochure Entitled "Diacel D Lightweight Cement Additive", 1999.

Halliburton Brochure Entitled "Cementing Flex-Plug® OBM Lost-Circulation Material", 2004.

Halliburton Brochure Entitled "Cementing FlexPlug® W Lost-Circulation Material", 2004.

Halliburton Brochure Entitled "Gilsonite Lost-Circulation Additive", 1999.

Halliburton Brochure Entitled "Micro Fly Ash Cement Component", 1999.
Halliburton Brochure Entitled "Silicalite Cement Additive", 1999.
Halliburton Brochure Entitled "Spherelite Cement Additive", 1999.
Halliburton Brochure Entitled "Increased Integrity With the Stratalock Stabilization System", 1998.
Halliburton Brochure Entitled "Perlite Cement Additive", 1999.
Halliburton Brochure Entitled "The Permseal System Versatile, Cost-Effective Sealants for Conformance Applications", 2002.
Halliburton Brochure Entitled "Pozmix® a Cement Additive", 1999.
Foreign Communication From a Related Counter Part Application, Dec. 9, 2005.
Foreign Communication From a Related Counter Part Application, Feb. 24, 2005.
R. Marquaire et al., "Primary Cementing by Reverse Circulation Solves Critical Problem in the North Hassi-Messaoud Field, Algeria", SPE 1111, Feb. 1996.
Foreign Communication From a Related Counter Part Application, Dec. 27, 2005.
Foreign Communication From a Related Counter Part Application, Feb. 23, 2006.
Foreign Communication From a Related Counter Part Application, Oct. 12, 2005.
Foreign communication from related counter part application dated Oct. 13, 2005.
Filippov, et al., "Expandable Tubular Solutions," Society of Petroleum Engineers, SPE 56500, Oct. 3-6, 1999.
Daigle, et al., "Expandable Tubulars: Field Examples of Application in Well Construction and Remediation," Society of Petroleum Engineers, SPE 62958, Oct. 1-4, 2000.
Carpenter, et al., "Remediating Sustained Casing Pressure by Forming a Downhole Annular Seal With Low-Melt-Point Eutectic Metal," IADC/SPE 87198, Mar. 2-4, 2004.
Halliburton Casing Sales Manual, Section 4, Cementing Plugs, pp. 4-29 and 4-30, Oct. 6, 1993.
G.L. Cales, "The Development and Applications of Solid Expandable Tubular Technology," Paper No. 2003-136, Petroleum Society's Canadian International Petroleum Conference 2003, Jun. 10-12, 2003.
Gonzales, et al., "Increasing Effective Fracture Gradients by Managing Wellbore Temperatures," IADC/SPE 87217, Mar. 2-4, 2004.
Fryer, "Evaluation of the Effects of Multiples in Seismic Data From the Gulf Using Vertical Seismic Profiles," SPE 25540, 1993.
Griffith, "Monitoring Circulatable Hole With Real-Time Correction: Case Histories," SPE 29470, 1995.
Ravi, "Drill-Cutting Removal in a Horizontal Wellbore for Cementing," IADC/SPE 35081, 1996.
MacEachern, et al., "Advances in Tieback Cementing," IADC/SPE 79907, 2003.
Davies, et al, "Reverse Circulation of Primary Cementing Jobs—Evaluation and Case History," IADC/SPE 87197, Mar. 2-4, 2004.
Abstract No. XP-002283587, "Casing String Reverse Cemented Unit Enhance Efficiency Hollow Pusher Housing".
Abstract No. XP-002283586, "Reverse Cemented Casing String Reduce Effect Intermediate Layer Mix Cement Slurry Drill Mud Quality Lower Section Cement Lining".
Brochure, Enventure Global Technology, "Expandable-Tubular Technology," pp. 1-6, 1999.
Dupal, et al, "Solid Expandable Tubular Technology—A Year of Case Histories in the Drilling Environment," SPE/IADC 67770, Feb. 27-Mar. 1, 2001.
DeMong, et al., "Planning the Well Construction Process for the Use of Solid Expandable Casing," SPE/IADC 85303, Oct. 20-22, 2003.
Waddell, et al., "Installation of Solid Expandable Tubular Systems Through Milled Casing Windows," IADC/SPE 87208, Mar. 2-4, 2004.
DeMong, et al., "Breakthroughs Using Solid Expandable Tubulars to Construct Extended Reach Wells," IADC/SPE 87209, Mar. 2-4, 2004.
Escobar, et al., "Increasing Solid Expandable Tubular Technology Realiability in a Myriad of Downhole Environments," SPE 81094, Apr. 27-30, 2003.
Griffith, et al., Reverse Circulation of Cement on Primary Jobs Increases Cement Column Height Across Weak Formations, Society of Petroleum Engineers, SPE 25440, 315-319, Mar. 22-23, 1993.
Foreign Communication From A Related Counter Part Application, Jan. 8, 2007.
Foreign Communicaton From A Related Counter Part Application, Jan. 17, 2007.

* cited by examiner

CEMENTING METHODS AND SYSTEMS FOR INITIATING FLUID FLOW WITH REDUCED PUMPING PRESSURE

BACKGROUND OF THE INVENTION

This invention relates to cementing casing in subterranean formations. In particular, this invention relates to methods for initiating circulation through the well bore to allow cement composition to flow into the well bore at low pressure. The circulation may be established in either reverse-circulation or conventional-circulation directions.

Typically, prior to cement operations, casing is inserted in a well bore. Circulation fluid fills the inner diameter ("ID") of the casing and the casing-by-well bore annulus. For purposes of this disclosure, "circulation fluid" is defined as circulation fluid, drilling mud, and/or any other fluid typically found in precement wells. Once stagnant in the well bore, the circulation fluid has a certain gel strength that renders the circulation fluid resistive to flow initiation. Thus, a higher pumping pressure is required to initiate fluid circulation than is required once circulation is established. Further, because cement composition is typically heavier than circulation fluid, once a sufficient amount of cement composition has been pumped into the well bore, gravity will pull the cement composition down into the well bore to drive fluid circulation through the well bore.

One method of pumping cement composition into the casing-by-well bore annulus involves pumping the cement composition down the casing at the well head. The cement composition is pumped at high pressure down the ID of the casing until it reaches a casing shoe. The cement composition then exits the casing ID into the annulus through the casing shoe. The cement composition then flows up the annulus from the casing shoe. Circulation fluid is usually pumped down the casing ID behind the cement composition to drive the cement composition through the casing shoe and up the annulus. In most instances, high pressure pumps and pumping systems are required to lift the cement composition from the casing shoe in the annulus. This establishes fluid flow in a conventional-circulation direction.

Another method of pumping a cement composition into the casing-by-well bore annulus involves pumping the cement composition directly into the annulus at the well head, which is generally referred to as "reverse-circulation." The circulation fluid flows in a reverse-circulation direction from the annulus, through the casing shoe and up through the ID of the casing where it flows out of the well head. Generally, this pumping method requires somewhat lower pumping pressures than flowing the fluid in the conventional direction, because the weight of the cement composition in the annulus helps to drive fluid flow.

In cases where cementing operations commence after the circulation fluid in the well bore has become stagnant, the gel strength of the circulation fluid and/or drilling mud should be overcome to initiate fluid circulation through the well. In both conventional-circulation and reverse-circulation methods, a certain pump pressure should be obtained to initiate fluid circulation. Circulation should be established to allow a sufficient quantity of cement composition to flow into the well bore for the weight of the cement composition to maintain fluid circulation.

SUMMARY OF THE INVENTION

This invention relates to cementing casing in subterranean formations. In particular, this invention relates to methods for initiating reverse-circulation through the well bore to allow cement composition to flow into the well bore at low pressure.

One aspect of the invention provides a method of initiating fluid circulation in a well bore through a casing inner diameter and an annulus outside the casing, the method having the following steps: increasing the annulus fluid pressure; flowing a cement composition into the annulus at the top of the well bore; and maintaining a difference in pressure between the fluid pressure of the casing inner diameter and the fluid pressure of the annulus until enough of the cement composition has entered the annulus to drive fluid circulation by the added cement composition weight.

According to a further aspect of the invention, there is provided a method of initiating fluid circulation in a well bore through a casing inner diameter and an annulus outside the casing, the method having the following steps: decreasing the casing inner diameter fluid pressure by removing fluid from the casing inner diameter; flowing a cement composition into the annulus at the top of the well bore; and maintaining a difference in pressure between the fluid pressure of the casing inner diameter and the fluid pressure of the annulus until enough cement composition has entered the annulus to drive fluid circulation by the added cement composition weight.

Another aspect of the invention provides a method of initiating fluid circulation in a well bore through a casing inner diameter and an annulus outside the casing, the method having the following steps: depositing a gas within the fluid in the casing inner diameter, whereby a portion of the fluid in the casing inner diameter is displaced by the gas; flowing a cement composition into the annulus at the top of the well bore; and continuing the depositing of a gas within the fluid in the casing inner diameter until enough of the cement composition has entered the annulus to drive fluid circulation by the added cement composition weight.

According to still another aspect of the invention, there is provided a method of cementing a casing in a well bore, the method having the following steps: connecting a low-pressure cement composition pump to an annulus between the well bore and the casing; pumping an initial amount of a cement composition at low pressure into the annulus, whereby fluid flow in a reverse-circulation direction through a well bore annulus and the casing inner diameter is initiated; maintaining fluid flow in a reverse-circulation direction through a well bore annulus and the casing inner diameter until enough of the cement composition has entered the annulus to drive fluid circulation by the added cement composition weight; disconnecting the low-pressure cement composition pump from the annulus; and flowing an additional amount of the cement composition into the annulus to complete a cement operation.

Another aspect of the invention provides a method of cementing a casing in a well bore, wherein an annulus is defined between the casing and the well bore, the method having the following steps: connecting a circulation fluid pump to the casing inner diameter; pumping circulation fluid out of the casing inner diameter, whereby fluid flow in a reverse-circulation direction through the casing inner diameter and annulus is initiated; maintaining fluid flow in a reverse-circulation direction through a well bore annulus and the casing inner diameter until an initial amount of a cement composition has entered the annulus sufficient to drive fluid circulation by the added cement composition weight; disconnecting the low-pressure cement composition pump from the annulus; and flowing an additional amount of the cement composition into the annulus to complete a cement operation.

According to a further aspect of the invention, there is provided a well bore cementing system for initiating fluid circulation in a well bore through a casing inner diameter and an annulus outside the casing, the system having: a low-pressure cement composition pump fluidly connected to the annulus, wherein the low-pressure cement composition pump is operable to initiate reverse-circulation fluid flow in the well bore; and a cement composition container fluidly connected to the annulus, wherein a cement composition is flowable from the container into the annulus once reverse-circulation fluid flow has been established.

According to another aspect of the present invention, there is provided a well bore cementing system for initiating fluid circulation in a well bore through a casing inner diameter and an annulus outside the casing, the system having several parts including: a low-pressure pump fluidly connected to the casing inner diameter, wherein the low-pressure pump is operable to remove fluid from the casing inner diameter to initiate reverse-circulation fluid flow in the well bore; and a cement composition container fluidly connected to the annulus, wherein a cement composition is flowable from the container into the annulus once reverse-circulation fluid flow has been established.

Another aspect of the invention provides a well bore cementing system for initiating fluid circulation in a well bore through a casing inner diameter and an annulus outside the casing, the system having components as follows: a gas introducing device fluidly connected to the casing inner diameter, wherein the gas inducing device is operable to introduce gas in the casing inner diameter to initiate reverse-circulation fluid flow in the well bore; and a cement composition container fluidly connected to the annulus, wherein a cement composition is flowable from the container into the annulus once reverse-circulation fluid flow has been established.

A further aspect of the invention imparts a method of initiating fluid circulation in a well bore through a casing inner diameter and an annulus outside the casing, the method including: increasing the casing inner diameter fluid pressure at the top of the well bore; flowing a cement composition into the casing inner diameter at the top of the well bore; maintaining a difference in pressure between the fluid pressure of the casing inner diameter and the fluid pressure of the annulus until enough of the cement composition has entered the casing inner diameter to drive fluid circulation by the added cement composition weight; reducing the casing inner diameter fluid pressure at the top of the well bore while flowing a further portion of cement composition into the casing inner diameter; and pumping at a relatively higher fluid pressure the cement composition from the casing inner diameter into the annulus through a lower end of the casing.

According to still another aspect of the invention, there is provided a method of initiating fluid circulation in a well bore through a casing inner diameter and an annulus outside the casing, the method including: decreasing the annulus fluid pressure by removing fluid from the annulus; flowing a cement composition into the casing inner diameter at the top of the well bore; maintaining a difference in pressure between the fluid pressure of the casing inner diameter and the fluid pressure of the annulus until enough of the cement composition has entered the casing inner diameter to drive fluid circulation by the added cement composition weight; and pumping at a relatively higher fluid pressure the cement composition from the casing inner diameter into the annulus through a lower end of the casing.

Still another aspect of the invention offers a method of initiating fluid circulation in a well bore through a casing inner diameter and an annulus outside the casing, the method including: depositing a gas within the fluid in the annulus, whereby a portion of the fluid in the annulus is displaced by the gas; flowing a cement composition into the casing inner diameter at the top of the well bore; maintaining a difference in pressure between the fluid pressure of the casing inner diameter and the fluid pressure of the annulus until enough of the cement composition has entered the annulus to drive fluid circulation by the added cement composition weight; and pumping at a relatively higher fluid pressure the cement composition from the casing inner diameter into the annulus through a lower end of the casing.

According to a further aspect of the invention, there is provided a method of cementing a casing in a well bore, the method including: connecting a low-pressure cement composition pump to the casing inner diameter; pumping an initial amount of a cement composition at low pressure into the casing inner diameter, whereby fluid flow in a conventional-circulation direction through a well bore annulus and the casing inner diameter is initiated; maintaining fluid flow in a conventional-circulation direction through a well bore annulus and the casing inner diameter until enough of the cement composition has entered the casing inner diameter to drive fluid circulation by the added cement composition weight; disconnecting the low-pressure cement composition pump from the casing inner diameter; flowing an additional amount of the cement composition into the casing inner diameter; connecting a high-pressure pump to the casing inner diameter; and pumping at a relatively higher fluid pressure the cement composition from the casing inner diameter into the annulus through a lower end of the casing.

Further aspects of the invention provide a method of cementing a casing in a well bore, wherein an annulus is defined between the casing and the well bore, the method including: connecting a pump to the annulus; pumping circulation fluid out of the annulus, whereby fluid flow in a conventional-circulation direction through the casing inner diameter and annulus is initiated; flowing an initial amount of a cement composition into the casing inner diameter; maintaining fluid flow in a conventional-circulation direction through a well bore annulus and the casing inner diameter until enough of the cement composition has entered the casing inner diameter to drive fluid circulation by the added cement composition weight; disconnecting the pump from the annulus; flowing an additional amount of the cement composition into the casing inner diameter; connecting a relatively higher pressure pump to the casing inner diameter; and pumping at a relatively higher fluid pressure the cement composition from the casing inner diameter into the annulus through a lower end of the casing.

Another aspect of the invention affords a well bore cementing system for cementing a casing in the well bore, the system including: a low-pressure cement composition pump fluidly connected to the casing inner diameter, wherein the low-pressure cement composition pump is operable to initiate conventional-circulation fluid flow in the well bore; a cement composition container fluidly connected to the casing inner diameter, wherein a cement composition is flowable from the container into the casing inner diameter once conventional-circulation fluid flow has been established; and a high-pressure pump fluidly connected to the casing inner diameter, wherein the high-pressure pump is operable to pump cement composition from casing inner diameter into the annulus through a lower end of the casing.

According to yet another aspect of the invention, there is provided a well bore cementing system for initiating fluid circulation in a well bore through a casing inner diameter and an annulus outside the casing and for cementing the casing, the system including: a low-pressure pump fluidly connected to the annulus, wherein the low-pressure pump is operable to remove fluid from the annulus to initiate conventional-circulation fluid flow in the well bore; a cement composition container fluidly connected to the casing inner diameter, wherein a cement composition is flowable from the container into the casing inner diameter once conventional-circulation fluid flow has been established; and a high-pressure pump fluidly connected to the casing inner diameter, wherein the high-pressure pump is operable to pump cement composition from casing inner diameter into the annulus through a lower end of the casing.

A still further aspect of the invention provides a well bore cementing system for initiating fluid circulation in a well bore through a casing inner diameter and an annulus outside the casing and for cementing the casing, the system including: a gas introducing device fluidly connected to the annulus, wherein the gas inducing device is operable to introduce gas in the annulus to initiate conventional-circulation fluid flow in the well bore; a cement composition container fluidly connected to the casing inner diameter, wherein a cement composition is flowable from the container into the casing inner diameter once conventional-circulation fluid flow has been established; and a high-pressure pump fluidly connected to the casing inner diameter, wherein the high-pressure pump is operable to pump cement composition from casing inner diameter into the annulus through a lower end of the casing.

The objects, features, and advantages of the present invention will be readily apparent to those skilled in the art upon a reading of the description of the preferred embodiments that follows.

BRIEF DESCRIPTION OF THE FIGURES

The present invention is better understood by reading the following description of non-limiting embodiments with reference to the attached drawings wherein like parts of each of the several figures are identified by the same referenced characters, and which are briefly described as follows.

It is to be noted, however, that the appended drawings illustrate only a few embodiments of this invention and are therefore not to be considered limiting of its scope, as the invention encompasses equally effective embodiments.

DETAILED DESCRIPTION OF THE INVENTION

Figure 1:
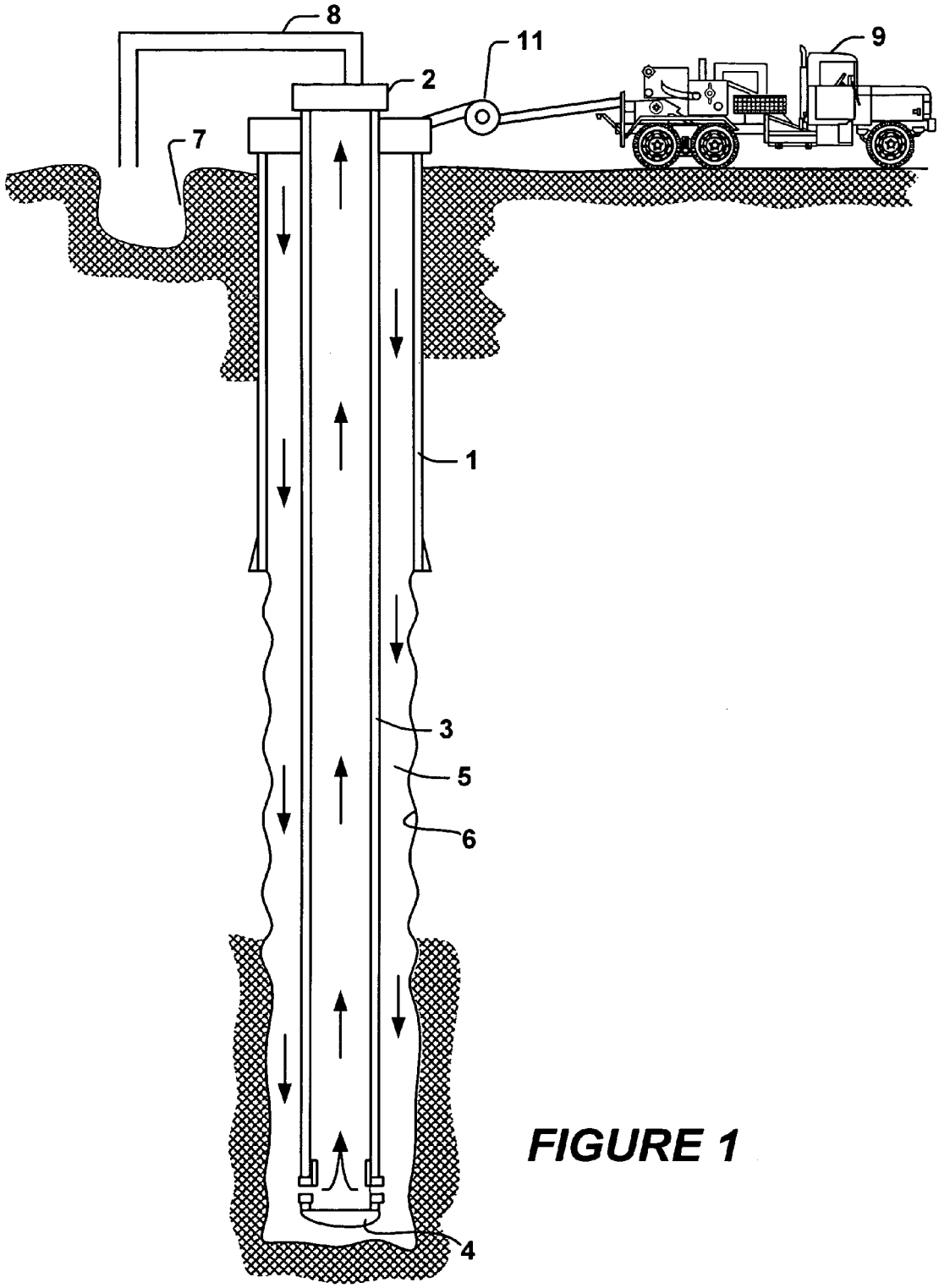
FIG. 1 is a cross-sectional, side view of a well bore having surface casing with an attached well head and cement casing hung from the well head and extending to the bottom of the well bore. A pump truck is parked near the well head.

Referring to FIG. 1, a cross-sectional side view of a well is shown. Surface casing 1 is set at the surface of the well and a well head 2 is connected to the surface casing 1. Casing 3 is suspended from the well head 2. The casing 3 has a shoe 4 at its lowermost end. An annulus 5 is defined between the casing 3 and the well bore 6. A receptacle 7 is positioned to receive fluid from the ID of the casing 3 via a pipe 8. A cement pump truck 9 is also shown at the surface parked in the vicinity of the well head 2.

In this embodiment of the invention, an electric pump 11 is fluidly connected to the annulus 5 through the well head 2. The inlet side of the electric pump 11 is connected to a pump truck 9. A cement composition is mixed by the cement pump truck 9 and pumped to the electric pump 11. The electric pump 11 pumps the cement composition from the cement pump truck 11 directly into the annulus 5 through the well head 2. To overcome the gel strength of the circulation fluid in the well bore, the electric pump 11 should produce enough head pressure to drive the cement composition into the annulus 5. The electric pump 11 is used to pump a sufficient amount of cement composition into the annulus 5 until the weight of the cement composition in the annulus 5 is sufficient to maintain fluid flow in the reverse-circulation direction through the annulus 5 and the inner diameter of the casing 3. When fluid circulation is established in the reverse-circulation direction, pumping with the electric pump 11 may be discontinued, and the cement pump truck 9 may be connected directly to the annulus 5 through the well head 2. In alternative embodiments, the electric pump 11 is not disconnected, but rather a manifold is used to bypass the pump or the remainder of the cement composition is flowed through the pump with the pump turned off. Returns from the casing inner diameter are taken through the pipe 8 and deposited in the receptacle 7. A remainder of cement composition is allowed to flow into the annulus 5 until the entire annulus is full. When the cement composition reaches the casing shoe 4, the flow of cement composition is stopped and the cement composition is allowed to harden or set in the annulus 5 as is well known to persons of skill.

Depending on the particular well configuration and circumstances, a differential pressure of 0.5 psi/ft may be sufficient to overcome the gel strength of the circulation fluid. The gel strength is highly dependent on the type of fluid found in the well bore and the depth of the well bore. Where only water is found in the well bore, a differential pressure of 0.05 psi/ft may be sufficient to overcome the gel strength.

Any pump capable of pumping cement composition may be used as are available and known to persons of skill, including, but not limited to: diaphragm pumps, peristaltic pumps, roper pumps, centrifugal pumps, triplex pumps, positive displacement pumps, progressive cavity pumps, and reciprocating pumps.

An electric reciprocating, positive displacement pump may be used. These pumps utilize gearing, crankshafts and connecting rods to translate rotational motion to linear motion inside the power end. The fluid is moved by the motion of either a plunger or piston reciprocating inside the fluid end. The volume pumped per crankshaft revolution is defined by the plunger/piston diameter and stroke length. Well service pumps of this type can operate from near zero flow rate upwards to 40 BPM and at pressures up to 20,000 psi. Smaller pumps of this type will operate inside these limits and are used as car wash pumps and in industrial cleaning operations. Reciprocating positive displacement pumps can be single-acting or double-acting.

Positive displacement pumps may be powered by either a diesel or electric motor. In the oilfield service industry, the horsepower requirements range from 300 BHP up to approximately 3,000 BHP. For diesel engines, transmissions are normally used to either increase the torque output of the engine by reducing the rotational speed therefore increasing the pressure output of the pump, or by increasing the rotational speed of the engine to increase the flow rate out of the pump. These transmissions can be either manual or automatic shifting. Electric motors can also be used with positive displacement pumps. These are generally variable speed motors in order to control the discharge rate and pressure for the pump. Positive displacement pumps suitable for use with the present invention are manufactured by Halliburton Energy Services, SPM and Gardner-Denver, and National Oilwell.

Centrifugal pumps (rotodynamic pumps) may also be used with the present invention. The pumps use a rotating impeller or impellers inside a fixed housing to impart energy to the fluid. The energy is in the form of velocity changes as the fluid passes through the vanes of the impeller(s). These pumps are described as radial flow, axial flow or mixed flow and can be single or multistaged, based on the geometry and number of impellers. Typical oilfield centrifugal pumps generally operate up to 150 psi and 4,000 gpm (based on pump size and horsepower available). Centrifugal pumps suitable for use in the present invention are manufactured by Deming, Gorman-Rupp, Galigher, Durco, Worthington, Mission, Allis-Chalmers and Duncan Equipment (for Halliburton centrifugal pumps).

Progressive cavity pumps, or screw pumps, are a special type of rotary positive displacement pump that may also be used in the present invention. In these pumps, the flow through the pumping elements is axial. The liquid is forced to travel circumferentially between the rotor and the stator, thus giving the screw pump a unique axial flow pattern and low internal velocities. The typical pressures range from 50 to 5,000 pounds per square inch with flow rates as high as 8,000 gal/min. Progressive cavity pumps can come in single stage, dual stage, or multiple stage pumps with the pressure ranges increasing with each stage, wherein all of these pumps may be used in the present invention. Progressive cavity pumps suitable for use with the present invention are manufactured by Moyno, Roper, Mono-pump, and National Oilwell.

Positive displacement rotary pumps may also be used with the present invention. There are various types of positive displacement rotary pumps, including vane, gear and lobe pumps. These pumps displace a finite volume or cavity of fluid with each rotation of the rotating and stationary parts. The pump enclosure initially opens to the pump inlet and expands as the pump rotates. As rotation continues, the volume progresses through the pump to a point where it is no longer open to the pump inlet but not yet open to the pump outlet. The volume continues to rotate until the volume opens to the outlet port and the vanes or gear continues to force the volume of captured fluid out the pump. Vane and lobe pumps are rated for up to 1,000 gpm and pressures up to 125 psi. Gear pumps have about the same rate but the pressure can reach about 225 psi in an internal gear pump. Manufactures of these types of pumps suitable for use with the present invention include: Oberdorfer, Borger, Eagle pump, Tuthill, Roper, and Viking.

Depending on the pressure required to initiate well bore fluid circulation, various pumps may be connected in a series to produce higher pumping pressures.

Pipes or flexible hose, such as hose made of a rubber and metal composite, may be used to connect the electric pump to the well head. Flow meters and densitometers may also be used to monitor flow rates and the density of the cement composition. Valves or manifolds may also be included in the system to stop or restrict cement composition flow on the upstream or downstream side of the electric pump.

This invention may be used to initiate fluid flow with low pressure in conventional-circulation or reverse-circulation directions, depending on the particular application. In some applications, it is desirable to inject a cement composition into the inner diameter of the casing for later movement of cement composition into the annulus. In these applications, a slow-setting cement composition is used or a cement composition that is activated to set after it is pumped from the casing ID into the annulus. The low-pressure pumping techniques disclosed throughout this disclosure are suitable for depositing a cement composition in the inner diameter of the casing according to a conventional-circulation direction. As the cement composition is pumped or flowed into the casing ID, returns are taken from the annulus. After the low-pressure pumping techniques have been used to deposit the cement composition in the casing, high-pressure pumps are later used to pump the cement composition from the casing ID into the annulus through a casing shoe or circulation valve. For example, with reference to the system shown in FIG. 1, the electric pump 11 may instead be used to pump a cement composition into the ID casing. As the cement composition is pumped into the inner diameter of the casing, returns are taken from the annulus 5 via the pipe 8 and deposited in the receptacle 7. After the cement is in the casing ID, high-pressure pumps are used to lift the cement composition up through the annulus 5 in the conventional-circulation flow direction. Premixed, on-site mixed, and stored cement compositions may be used with the electric pump to initiate flow. This embodiment of the invention allows a first operator to use low pressure techniques to deposit the cement composition in the ID of the casing. Before the cement composition has set, a second operator may later use high pressure techniques to pump the cement composition from the ID of the casing into the annulus.

Figure 2:
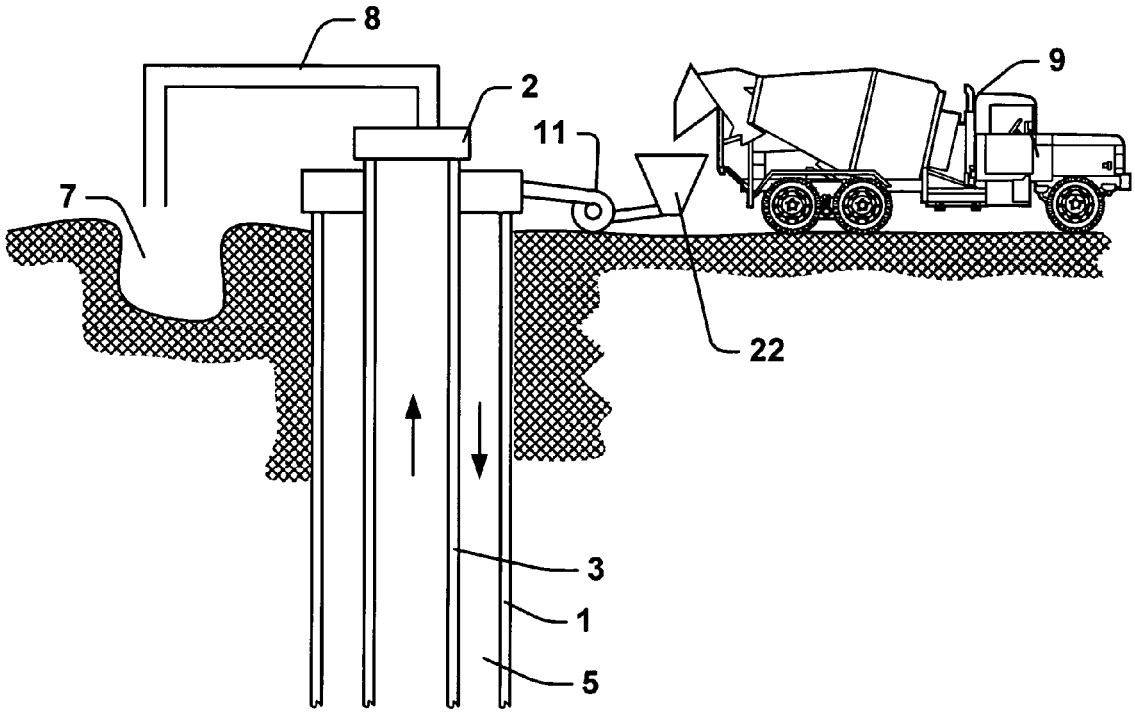
FIG. 2 is a cross-sectional, side view of a well bore having surface casing with an attached well head and cement casing hung from the well head and extending to the bottom of the well bore. A premixed cement truck is parked near the well head.

Referring to FIG. 2, a cross-sectional, side view is shown of a well bore configuration similar to that illustrated in FIG. 1. However, rather than a cement pump truck, a premixed cement truck 9 is parked near the well head 2. Also, a hopper 22 is connected to the electric pump 11. Premixed cement composition is deposited into the hopper 22 from the premixed cement truck 9. Cement composition from the hopper 22 is pumped into the annulus 5 by the electric pump 11. While a hopper is illustrated, any type of collection and/or mixing container may be used. In other embodiments, the cement composition is not premixed or mixed on site by a cement pump truck. Rather, the cement is mixed at the well site in a hopper or other container for pumping into the well bore. The cement composition may also be mixed and stored at the well site for a long period of time and then subsequently pumped with a "setting" or "hardening" additive by the electric pump from a storage vessel into the well bore. Premixed, on-site mixed, and stored cement compositions may be used with all embodiments of the invention described herein.

Figure 3A:
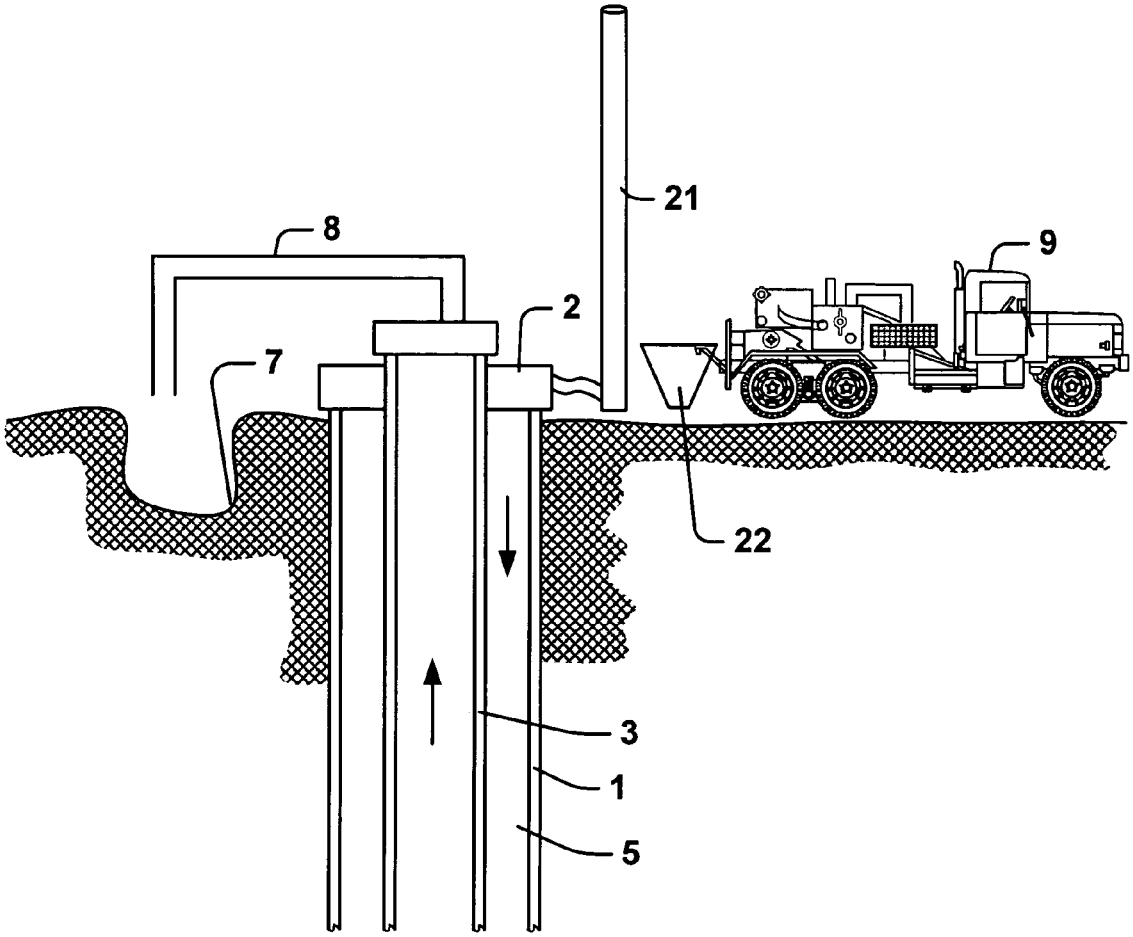
FIG. 3A is a cross-sectional, side view of a well head with casing, surface casing and a standpipe attached to the well head.

FIG. 3A shows a cross-sectional, side view of a well. The well has a surface casing 1, a well head 2 and a casing 3 suspended from the well head 2 within the surface casing 1. An annulus 5 is defined between the surface casing 1 and the casing 3. Returns are taken from the inner diameter of the casing 3 and deposited in a receptacle 7 via a pipe 8. A cement pump truck 9 is parked in the vicinity of the well head 2.

In this embodiment, one end of a standpipe 21 is fluidly connected to the annulus 5 through the well head 2. An end of the standpipe 21 is connected via a pipe or flexible hose, such as a hose made of a rubber and metal composite, to the well head 2 or the lower end of the standpipe 21 is plugged with a stopper and a hose is connected to a coupling near the end of the standpipe. With the standpipe 21 laid horizontally on the ground or in any manageable configuration (not shown), cement composition from the cement pump truck 9 or a hopper 22 is allowed to flow into the standpipe 21. When the standpipe 21 is full of cement composition, it is then raised to a substantially vertical position as illustrated in FIG. 3A. Depending on the particular well configuration, a standpipe 21 that is 10-15 feet tall may be sufficient to initiate reverse-circulation by the head pressure generated when the standpipe 21 is raised to a vertical position. Any length of standpipe may be used. A derrick, crane or any other available means may be used to raise the standpipe. Also, any pipe suitable for this purpose may be used, including a section of production pipe, drill pipe, coil tubing, or flexible pipe. The standpipe 21 acts like a "water tower" to pressurize the cement composition in the standpipe 21. When the hydrostatic pressure is sufficient to overcome the gel strength of the circulation fluid in the annulus 5 and ID of the casing 3, cement composition then flows from the standpipe 21 into the annulus 5.

Depending on the configuration of the well, it may be necessary to pump more than one standpipe-volume of cement composition into the annulus 5 to initiate reverse-circulation flow. To this end, the standpipe is again horizontally positioned and recharged with more cement composition. The recharged standpipe 21 is again lifted to a vertical position to allow the cement composition to flow from the standpipe into the annulus 5 through the well head 2. This process may be repeated as many times as necessary to initiate fluid circulation in the well.

Figure 3B:
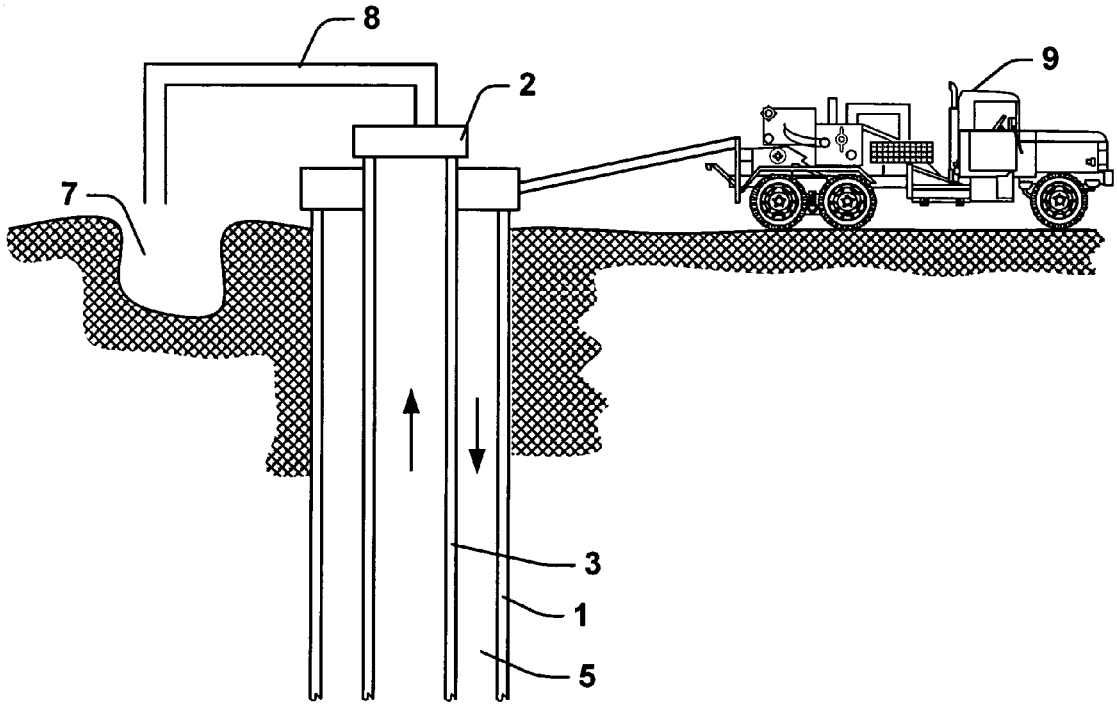
FIG. 3B is a cross-sectional, side view of the well head shown in FIG. 2A, wherein the standpipe is removed from the well head and a pump truck is attached to the well head.

As shown in FIG. 3B, a cross-sectional, side view of the well bore of FIG. 3A is shown. When an amount of cement composition sufficient to maintain fluid circulation has been pumped into the annulus 5, the cement pump truck 9 or a hopper (not shown) is then connected directly to the annulus 5 via the well head 2. The connection is made by a pipe or flexible hose. Cement composition is then pumped directly from the cement pump truck 9 into the annulus 5 through the well head 2. Since fluid flow in the reverse-circulation direction had already been established by the standpipe 21, cement composition now flows freely from the truck into the annulus 5. Depending on the well configuration, the cement pump truck 9 may also pressurize the cement composition to assist the flow into the annulus in addition to use of the standpipe 21. As noted above, premixed, on-site mixed, and stored cement compositions may be used with a standpipe to initiate flow.

A standpipe may also be used to initiate circulation in the conventional direction by pumping cement composition into the ID of the casing and taking returns out of the annulus.

Figure 4A:
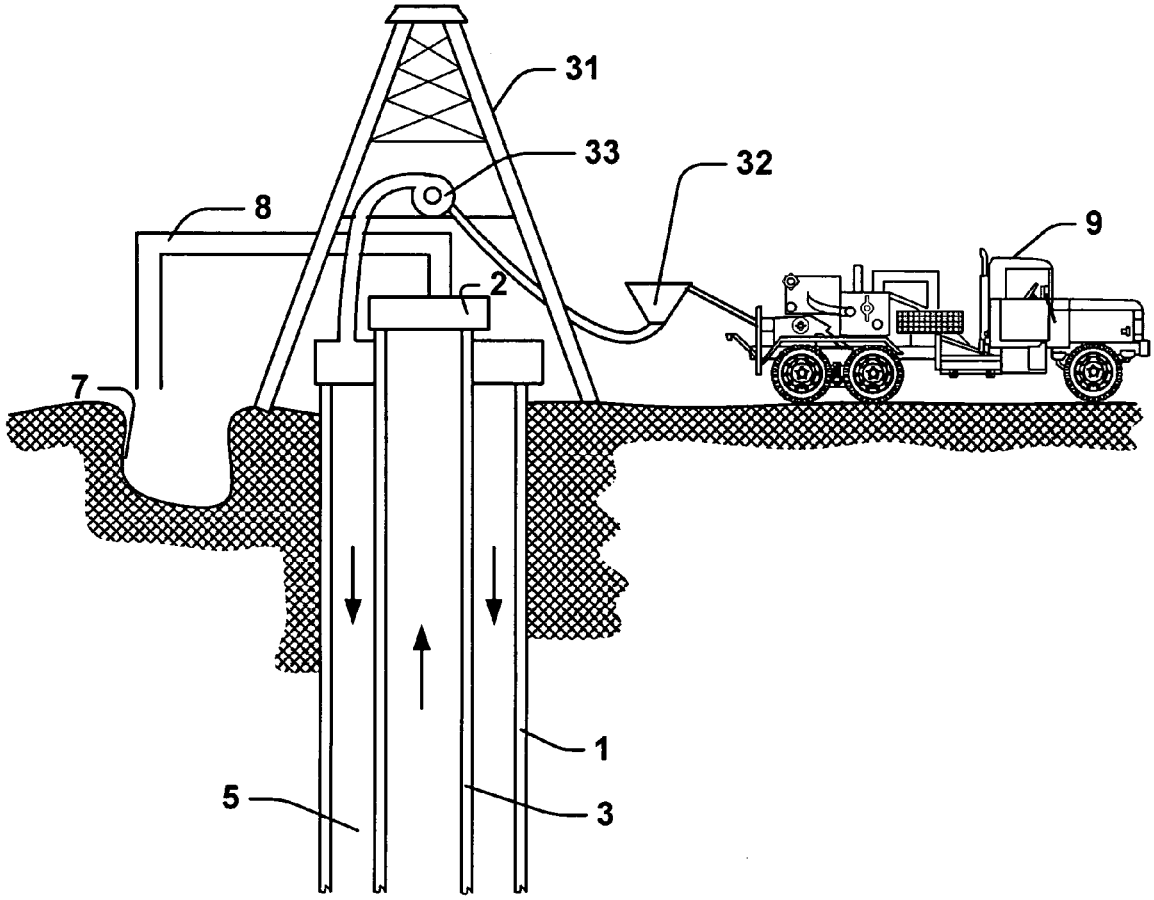
FIG. 4A is a cross-sectional, side view of a well head with surface casing and cement casing, wherein a derrick is positioned over the well head and a rig pump is connected to the well head.

Referring to FIG. 4A, a cross-sectional, side view of a well is illustrated, wherein the well has a surface casing 1 and a casing 3 hung from a well head 2. An annulus 5 is defined between the surface casing 1 and the casing 3. A receptacle 7 receives returns from the inner diameter of the casing 3 via a flow line 8. A cement pump truck 9 is parked in the vicinity of the well head 2. A derrick 31 is positioned above the well head 2. A rig pump 33 is associated with the derrick 31. The outlet of the rig pump 33 is connected to the annulus 5 through the well head 2. The inlet of the rig pump 33 is connected to a hopper 32 and the cement pump truck 9 is positioned to pump cement composition into the hopper 32. In other embodiments of the invention, the hopper is omitted.

To initiate circulation of the fluid in the well with the cement composition, the cement composition from the cement pump truck 9 is dumped into the hopper 32. The rig pump 33 pumps the cement composition from the hopper 32 directly into the annulus 5. The cement composition in the annulus 5 drives the circulation fluid downward in the annulus 5 and up through the inner diameter of the casing 3. The rig pump 33 is used to pump cement composition until a sufficient amount of cement composition is in the annulus to maintain, by its own weight, fluid flow in a reverse-circulation direction. Depending on the particular application, the rig pump 33 may be used to initiate fluid flow in the conventional-circulation or reverse-circulation directions. As noted above, premixed, on-site mixed, and stored cement compositions may be used with the rig pump to initiate flow.

Any type of rig pump capable of pumping cement composition may be used to initiate fluid flow. Any of the pumps described above may be used with this aspect of the invention. Pipes or flexible hose, such as hose made of a rubber and metal composite, may be used to connect the rig pump 33 to the well head 2. Flow meters and densitometers may also be used to monitor flow rates and the density of the cement composition. Valves or manifolds may also be included in the system to stop or restrict cement composition flow.

Figure 4B:
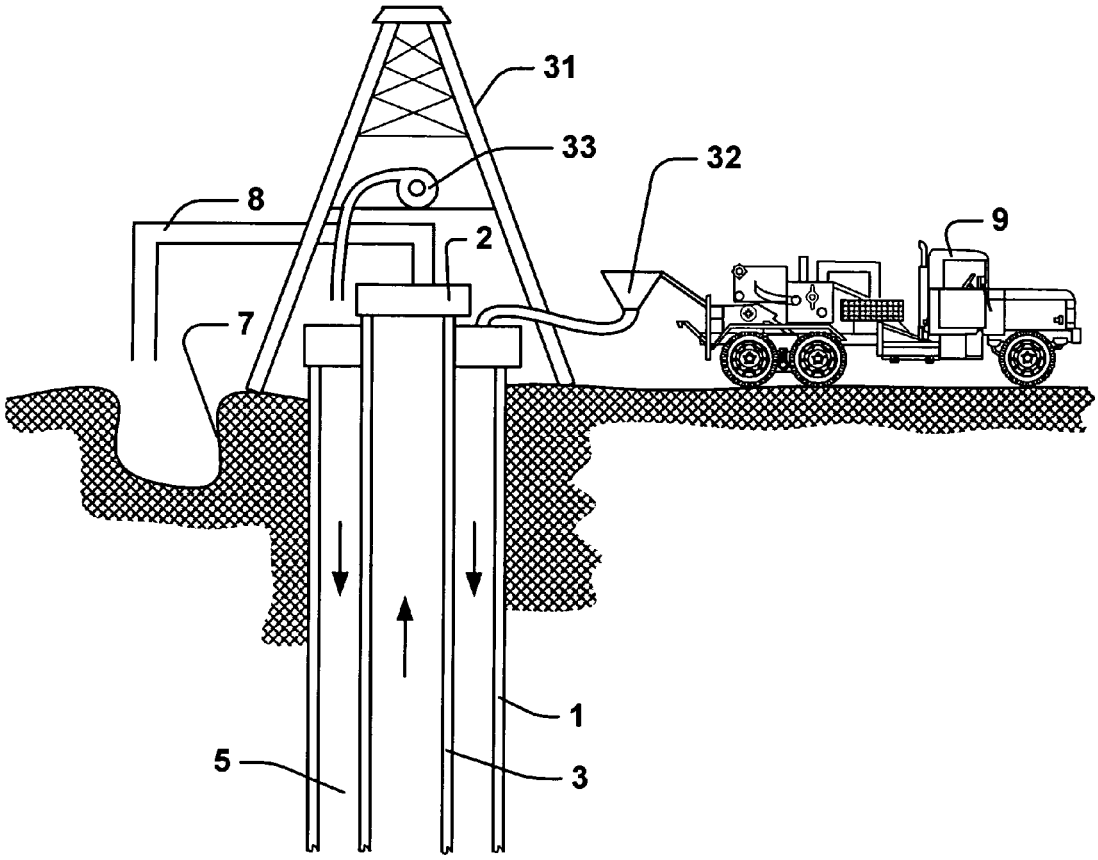
FIG. 4B is a cross-sectional, side view of the well head shown in FIG. 3A, wherein the rig pump is disconnected from the system.

FIG. 4B shows a cross-sectional, side view of the well illustrated in FIG. 4A. In this illustration, the rig pump 33 is disconnected from the hopper 32 and the hopper is connected directly to the annulus 5 through the well head 2. The weight of the cement composition in the annulus eventually becomes sufficient to maintain fluid flow in the reverse-circulation direction. Once fluid flow is established in the reverse-circulation direction, the rig pump 33 is disconnected from the well head 2 and the hopper 32 is directly connected to the well head 2. Depending on the application, the rig pump may remain connected to the hopper and the annulus as the remainder of the cement composition is flowed into the well bore.

Figure 5:
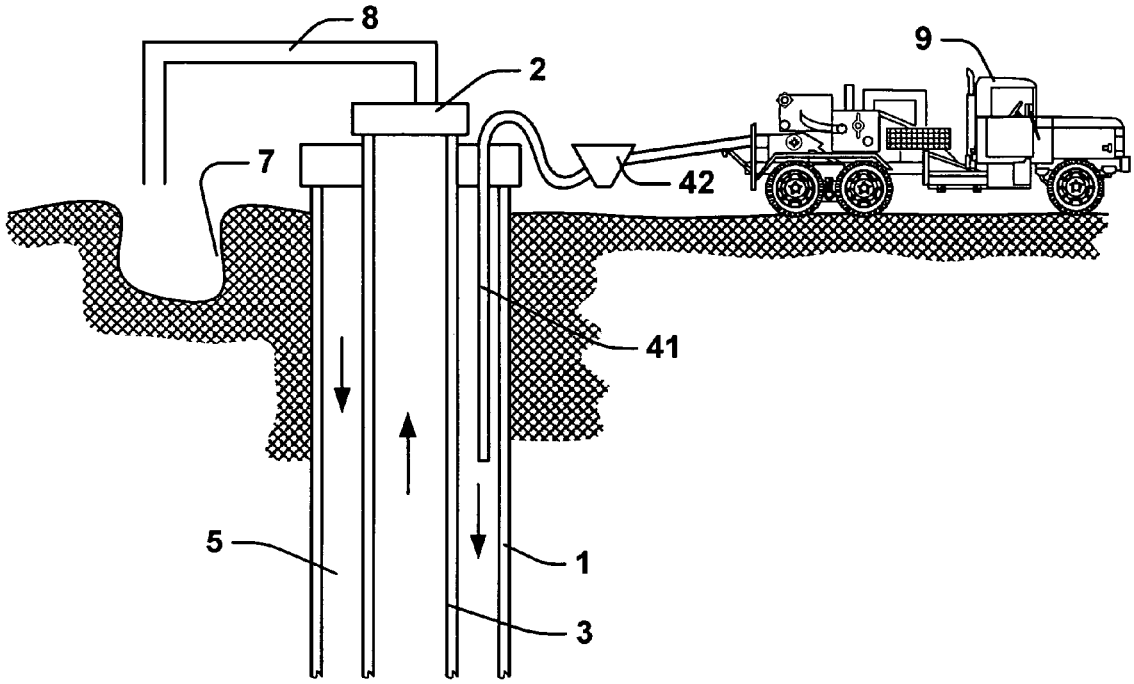
FIG. 5 is a cross-sectional, side view of a well head attached to surface casing and cement casing in a well bore, wherein a siphon pump is suspended in the annulus from the well head.

Referring to FIG. 5, a cross-sectional, side view of a well is shown that is similar to those previously discussed. As before, the well has a surface casing 1 and casing 3 suspended from a well head 2. The inner diameter of the casing 3 is connected to a flow line 8 for depositing returns in a receptacle 7. An annulus 5 is defined between the surface casing 1 and the casing 3. A cement pump truck 9 is parked in the vicinity of the well head 2.

In this embodiment, a hopper 42 is connected to a siphon pump 41. The siphon pump 41 is a long section of pipe or tubing suspended in the annulus 5 from the well head 2. Any type of pipe, tubing, flexible hose, etc. known to persons of skill may be used as the siphon pump to initiate fluid flow. The siphon pump 41 is filled with cement composition prior to insertion into the annulus. Once fully inserted into the annulus 5, the siphon pump is opened to allow gravity to pull the cement composition in the siphon pump 41 down into the annulus 5. As the cement composition in the siphon pump 41 is drawn downward, additional cement composition from the hopper 42 is drawn into the siphon pump 41 from the hopper 42. As discussed previously, the siphon pump 41 may be used until an amount of cement composition sufficient to initiate reverse-circulation is pumped into the annulus. Once reverse-circulation is established, the siphon pump 41 may be withdrawn from the annulus 5 and the hopper 42 may be connected directly to the annulus 5 through the well head 2.

Alternatively, a hopper may be omitted so that the cement pump truck 9 is connected directly to the siphon pump 41. After the cement composition filled siphon pump is inserted into the annulus, the pump truck may be used to inject additional cement composition into the siphon pump at low pressure. Flow meters and densitometers may also be used to monitor flow rates and the density of the cement composition. Valves may also be included in the system to stop or restrict cement composition flow.

A siphon pump may also be used to initiate circulation in the conventional direction and to deposit a cement composition in the casing ID for later high-pressure pumping to the annulus.

In an alternative embodiment of the invention, a vacuum is induced in the inner diameter of the casing 3 to draw circulating fluid out of the casing ID to enable cement composition to be pumped into the annulus at a lower-than-normal pressure to establish flow in the reverse-circulation direction. In addition to drawing circulation fluid out of the casing ID, the vacuum pump may be used to create vacuum pressure in the casing ID sufficient to cause the circulation fluid to vaporize or boil, which lowers the weight of the fluid column in the casing ID to induce circulation fluid flow in the reverse-circulation direction. In implementing these embodiments of the invention, one should recognize that high-pressure wells are susceptible to blow-out. By reducing the weight of the fluid column in the casing ID or generating a vacuum in the casing ID, the risk of blow-out is increased. Blow-out prevention techniques, as are known in the art, may be implemented to reduce this risk.

Figure 6:
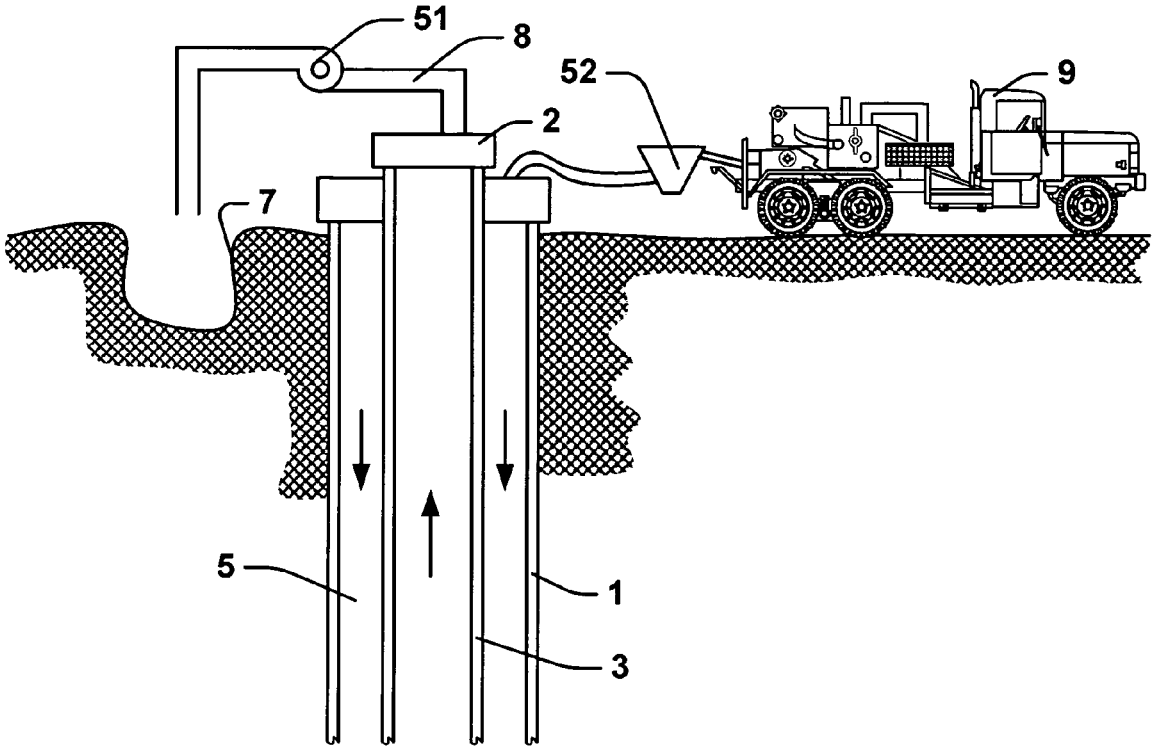
FIG. 6 is a cross-sectional, side view of a well bore having a surface casing and cement casing attached to a well head, wherein a vacuum pump is connected to the ID of the casing for discharging circulation fluid into a receptacle.

Referring to FIG. 6, a cross-sectional, side view of a well head is shown as previously discussed. The well head 2 is connected to surface casing 1 and suspends casing 3 in the well bore. An annulus 5 is defined between the surface casing 1 and the casing 3. Returns from the ID of the casing 3 are deposited in a receptacle 7 via a flow line 8. A cement pump truck 9 is parked in the vicinity of the well head 2. A hopper 52 is connected directly to the annulus 5 through the well head 2. A vacuum pump 51 is connected in the flow line 8 between the well head 2 and the receptacle 7.

Cement composition from the cement pump truck 9 is deposited in the hopper 52 and allowed to flow into the annulus 5. To initiate fluid flow and the reverse-circulation direction, the vacuum pump 51 draws circulation fluid out of the ID of the casing 3 and deposits the fluid in the receptacle 7. A combination of reduced pressure in the ID of the casing 3 caused by the vacuum pump 51 and increased pressure in the annulus 5 caused by cement composition from the hopper 52 initiates fluid flow in the reverse-circulation direction. Once fluid flow has been established, the vacuum pump 51 may be disengaged from the flow line 8 to allow fluid to flow directly from the ID of the casing 3 into the receptacle 7 through the flow line 8. Alternately the pump is not disengaged and is used to further assist the flow and/or simply pass through the fluids.

Any type of pump capable of drawing the circulation fluid out of the casing ID may be used to initiate fluid flow. Any of the pumps identified or described herein may by used in this aspect of the invention. In some embodiments of the invention, the vacuum pump is a pump on a vacuum truck. For example, vacuum trucks suitable for use with the invention include GapVax® Hydro-Excavator trucks having container capacities as high as 1,600 gallons and pumps that produce vacuum as great as 28" Hg. Pipe or flexible hose, such as hose made of a rubber and metal composite, may be used to connect the vacuum pump 51 to the well head 2. Flow meters and densitometers may also be used to monitor flow rates and the density of the cement composition flowing into the annulus or the circulation fluid flowing out of the ID of the casing 3. Valves may also be included in the system to stop or restrict cement composition and/or circulation fluid flow. Also, a tail pipe or macaroni string (coiled tubing) may be inserted down the ID of the casing 3 and attached to the vacuum pump 51. Submersible pumps may also be inserted into the inner diameter of the casing to a certain depth below the surface to pump the circulation fluid out of the inner diameter of the casing. Suitable submersible pumps include those manufactured by Mono Pump and Flight ITT.

A vacuum pump may also be used to initiate circulation in the conventional direction and to deposit a cement composition in the casing ID for later high-pressure pumping into the annulus. The vacuum pump is simply connected to the annulus and the cement composition is injected into the ID of the casing.

Figure 7:
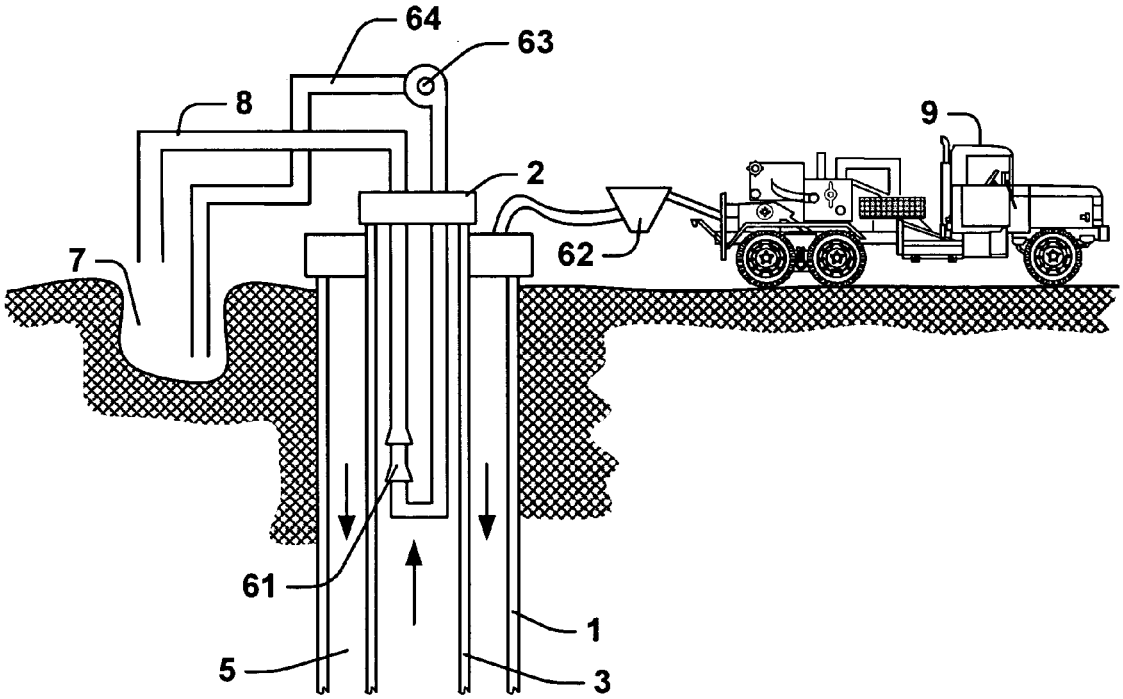
FIG. 7 is a cross-sectional, side view of a well head having surface casing, cement casing, and a well head, wherein a Venturi jet pump is inserted through the well head into the ID of the cement casing.

FIG. 7 illustrates a cross-sectional, side view of a well as previously described. A surface casing 1 is inserted into the well bore. A well head 2 is attached to the surface casing 1, and a casing 3 is suspended from the well head 2 in the well bore. An annulus 5 is defined between the surface casing 1 and the casing 3. A receptacle 7 receives fluid from the ID of the casing 3 through a flow line 8. A cement pump truck 9 is parked in the vicinity of the well head 2. A Venturi jet pump 61 is positioned inside the ID of the casing 3. The outlet port of the Venturi jet pump 61 is connected to the flow line 8 to deposit circulation fluid from the ID of the casing 3 into the receptacle 7. The intake of the Venturi jet pump 61 is connected to the receptacle 7 via an intake flow line 64. A fluid pump 63 is connected in the intake flow line 64 so as to draw fluid from the receptacle 7 and pump the fluid to the Venturi jet pump 61.

Because the Venturi jet pump 61 sucks the fluid out of the ID of the casing 3, a lower relative pressure is induced in the ID of the casing 3 whereby fluid flow in the reverse-circulation direction may be initiated. As more and more cement composition flows into the annulus 5 from the hopper 62, the weight of the cement composition in the annulus will begin to drive flow in the reverse-circulation direction. When the Venturi jet pump 61 is no longer necessary to maintain fluid flowing in the reverse-circulation direction, the Venturi jet pump 61 may be withdrawn from the ID of the casing 3. Alternatively, the Venturi jet pump 61 may be positioned at the surface on the outside of the well head 2 so as to create a vacuum pressure in the inner diameter of the casing. Where the Venturi jut pump is placed inside the inner diameter of the casing, circulation fluid at lower depths may be pulled from the casing.

The Venturi jet pump 61 may be positioned at the well head 3 or lowered into the inner diameter of the casing 4. The Venturi jet pump 61 may be lowered to any desired depth, for example, 60 to 150 feet, so long as enough suction could be supplied to break the frictional resistance and start circulation. Any type of Venturi pump capable of drawing the circulation fluid out of the casing ID may be used to initiate fluid flow. However, care should be taken in choosing a Venturi pump, because these pumps are typically capable of pulling a deep vacuum. If excessive vacuum is pulled on the fluid in the inner diameter of the casing, the pump may dehydrate the cement composition in the annulus or perhaps even collapse the casing 3.

A Venturi pump may also be used to initiate circulation in the conventional direction and to deposit a cement composition in the casing ID for later high-pressure pumping into the annulus. The Venturi pump, in that case, is connected to or inserted into the annulus.

Figure 8:
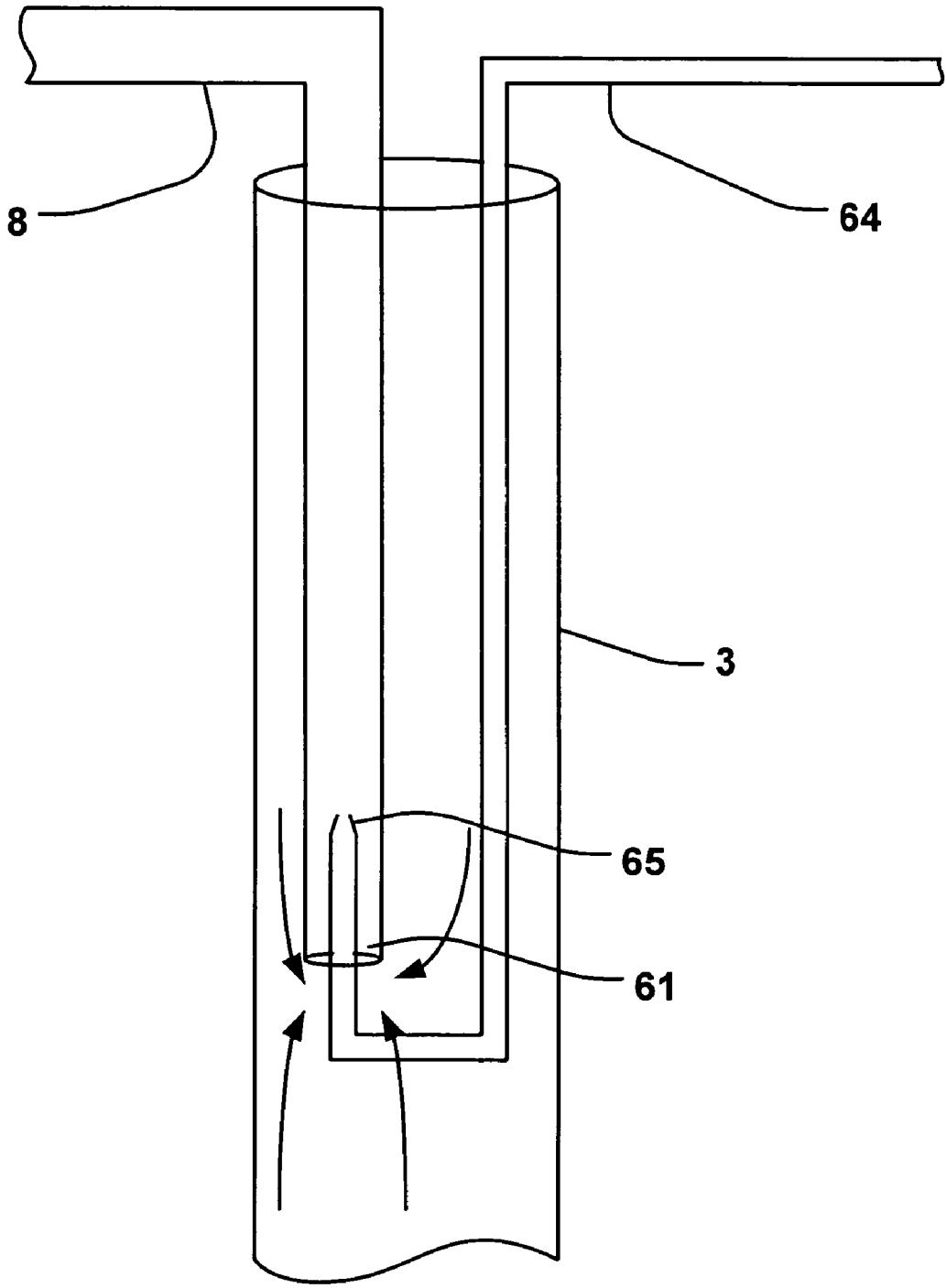
FIG. 8 is a cross-sectional, side view of a Venturi jet pump for use in the inner diameter of a casing as identified relative to FIG. 7.

FIG. 8 illustrates a cross-sectional, side view of an illustrative embodiment of the Venturi jet pump identified in FIG. 7. The Venturi jet pump 61 is run into the inner diameter of the casing 3 to a desired depth. The Venturi jet pump 61 is made of a flow line 8 and an intake flow line 64, wherein the end of the intake flow line 64 is inserted into the end of the flow line 8. In the illustrative embodiment, the inside diameter of the flow line 8 is larger than the outside diameter of the intake flow line 64 so as to allow circulation fluid inside the casing 3 to enter the flow line 8 through the annular gap between the two flow lines. The end of the intake flow line 64 may also be equipped with a nozzle 65 to increase the velocity of fluid injected from the intake flow line 64 into the flow line 8.

Venturi pumps or jet pumps transfer energy from a liquid or gas primary fluid to a secondary fluid, in order to produce flow. The jet pump offers significant advantages over mechanical pumps such as no moving parts, adaptability of installation, simplicity, and low cost. The primary drawback is efficiency. Venturi or jet pumps suitable for use with the present invention are manufactured by: Gould, Weatherford, and Halliburton Energy Services.

Figure 9:
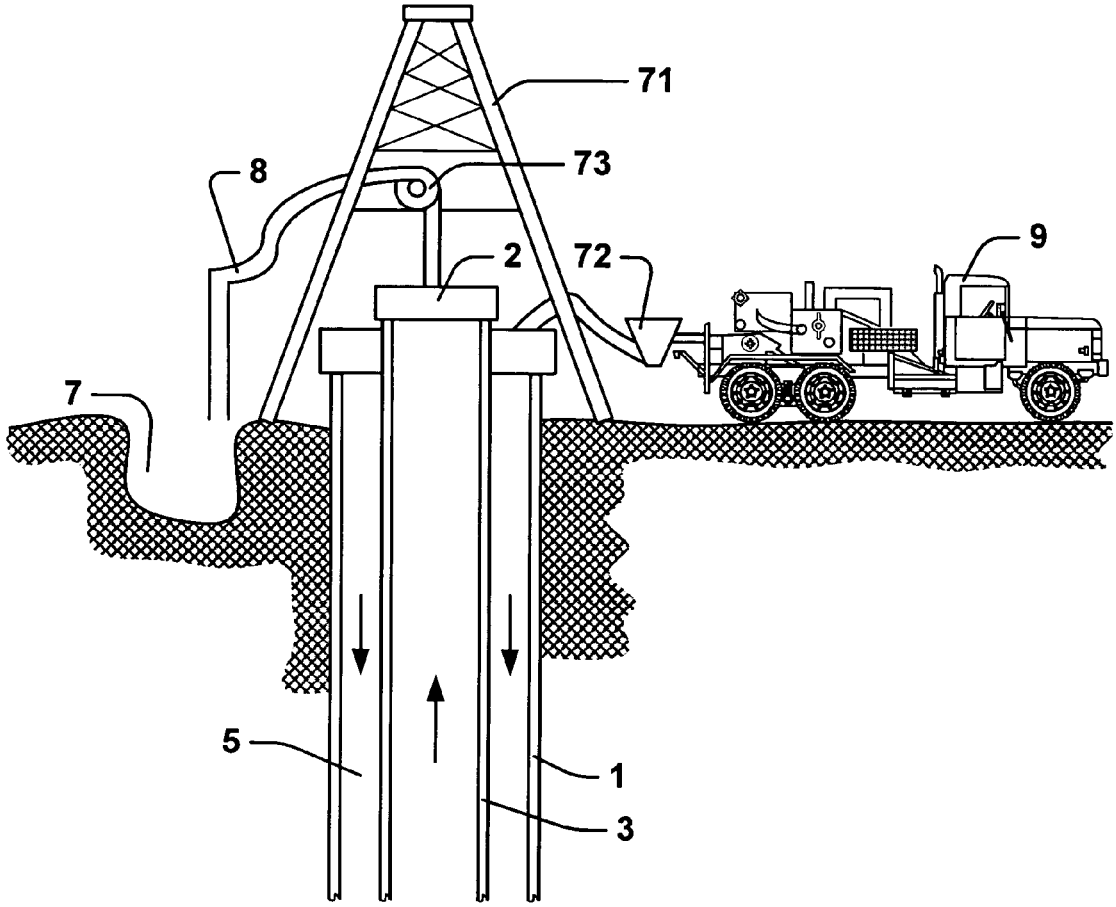
FIG. 9 is a cross-sectional, side view of a well bore having surface casing, cement casing, and a well head, wherein a derrick is positioned over the well head and the rig pump is connected to the inner diameter of the cement casing through the well head.

FIG. 9 is a cross-sectional, side view of a well bore having a well head 2 connected to surface casing 1 and having casing 3 suspended therein. As before, an annulus 5 is defined between the surface casing 1 and the casing 3. A receptacle 7 is positioned to receive returns from the ID of the casing 3 by a flow line 8. A hopper 72 is connected to the annulus 5 through the well head 2 and is positioned to receive cement composition from a cement pump truck 9. A derrick 71 is positioned over the well bore. A rig pump 73 is connected in the flow line 8 for drawing fluid out of the ID of the casing 3.

In this embodiment, the rig pump 73 is used to initiate fluid flow in the reverse-circulation direction by drawing fluid out of the ID of the casing 3. As previously described, cement composition is pumped into the hopper 72 for insertion into the annulus while the fluid is drawn out of the ID of the casing 3. Differential pressures then initiate fluid flow in the reverse-circulation direction. As soon as enough cement composition has flowed into the annulus, the weight of the cement composition will then maintain fluid flow in the reverse-circulation direction so that the rig pump 73 may be disengaged from the flow line 8. Also, a tail pipe or "macaroni string" (coiled tubing) may be inserted down the ID of the casing 3 and attached to the rig pump 73. Alternatively, the rig pump is not disconnected throughout the entire cementing operation.

Depending on the particular application, the rig pump 33 may be used to initiate fluid flow in the conventional-circulation or reverse-circulation directions. For example, the hopper 72 may be connected to the inner diameter of the casing, and the rig pump may be connected to the annulus to enable placement of the cement composition in the inner diameter of the casing for later pushing the cement composition into the annulus with a different pump. In that case, the rig pump is used to initiate conventional-circulation fluid flow by drawing circulation fluid out of the annulus. As noted above, premixed, on-site mixed, and stored cement compositions may be used with the rig pump to initiate flow.

Figure 10:
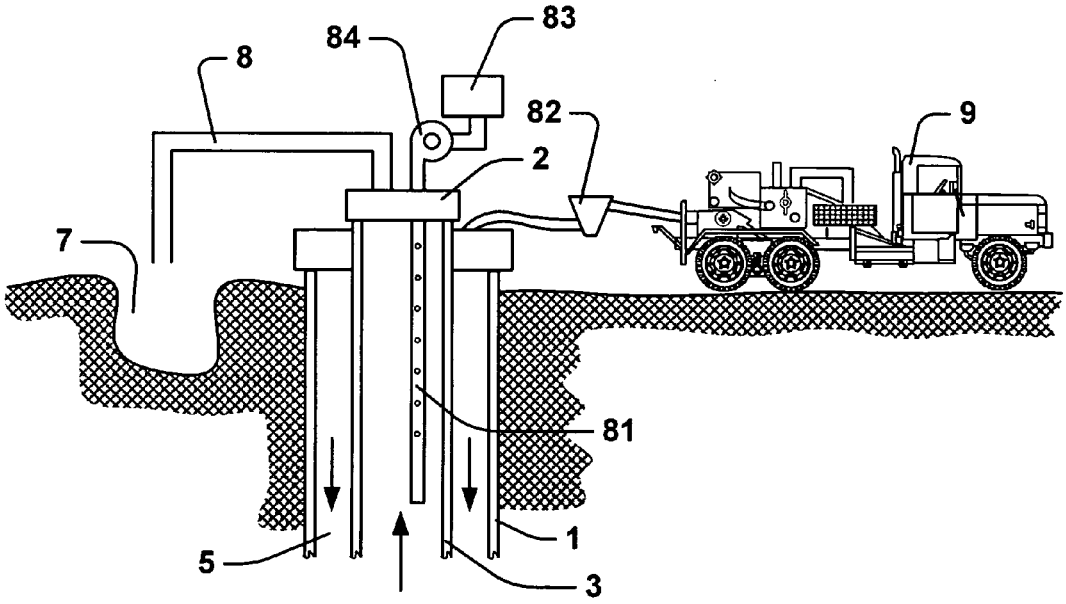
FIG. 10 is a cross-sectional, side view of a well bore having surface casing, cement casing, and a well head, wherein a pump is connected to an injector tube inserted into the ID of the casing through the well head.

Referring to FIG. 10, a cross sectional side view of a well bore is shown. A casing 3 is suspended from a well head 2, which is connected to surface casing 1. An annulus 5 is defined between the surface casing 1 and the casing 3. A receptacle 7 is positioned to receive returns from the ID of casing 3 via a flow line 8. A cement pump truck 9 is parked in the vicinity of the well head 2. A hopper 82 is connected to the annulus 5 through the well head 2. In this embodiment, a fluid-gas line 81 is inserted into the ID of casing 3 through the well head 2. The outlet of a fluid-gas pump 84 is connected to the fluid-gas line 81. The inlet of the fluid-gas pump 84 is connected to a fluid-gas storage tank 83.

To initiate reverse-circulation fluid flow, fluid and/or gas is pumped from the storage tank 83 by the fluid-gas pump 84 into the fluid-gas line 81. The fluid-gas line 81 has perforations along its length for depositing fluid and/or gas at various depths in the ID of the casing 3. If fluid is pumped into the ID of the casing 3, the fluid is a gas-generating fluid that vaporizes after injection. Whether it be gas or fluid that is injected into the ID of the casing 3, vapor displaces the circulating fluid in the ID of the casing to reduce the weight of the fluid column. Because the vapor weighs significantly less than the circulation fluid in the ID of the casing 3, the vapor induces fluid flow in the reverse-circulation direction by a difference in column weight between the fluid in the ID of the casing 3 and the fluid in the annulus 5. This allows cement composition to be pumped into the annulus at lower-than-normal pressure. As previously indicated, when enough cement composition is deposited in the annulus 5 to maintain fluid flow, the fluid-gas line 81 may be withdrawn from the ID of the casing 3. Alternatively, the fluid-gas line 81 is left in the well bore throughout the entire cementing operation.

This invention may also be used to initiate fluid flow in a conventional-circulation direction. The fluid-gas line is simply inserted into the annulus rather than the inner diameter of the casing.

In an alternative embodiment of the invention, a gas under pressure is pumped into the inner diameter of the casing to displace the circulating fluid into the annulus through the casing shoe. Excess circulation fluid is taken out of the well bore at the surface from the annulus. The weight of the fluid/gas column in the inner diameter of the casing is less than the weight of the fluid column in the annulus because of the difference in fluid height. With the gas charged in the inner diameter of the casing, the cement composition is then introduced at the well head into the annulus. The pressurized gas in the inner diameter of the casing is then bled off, allowing the circulating fluid and cement composition in the annulus to reverse-circulate through the casing shoe. After the gas has bled out of the casing inner diameter, returns are then taken out of the casing ID until the cement composition is placed in the annulus.

Also, gas under pressure may similarly be pumped into the annulus to use the same method to initiate circulation in the conventional direction and to deposit a cement composition in the casing ID for later high-pressure pumping into the annulus.

According to another embodiment of the invention, a circulation fluid is formulated with a gas-generating additive. In certain embodiments, the circulation fluid formulated with the gas-generating additive may function as a shock absorber. After the gas has formed in the casing ID and pushed the circulating fluid into the annulus, the operator bleeds the gas from the casing, which permits the cement composition and circulating fluid to flow down the annulus at reduced pressure. Depending on the slurry formulation, the gas formation in the casing inner diameter may take minutes, hours or days to vaporize. As long as the valve to the casing inner diameter is closed, vapor generated in the casing inner diameter will form a trapped air pocket in the top of the casing inner diameter. As more and more vapor is generated, the vapor drives fluid into the annulus and/or creates a fluid column in the casing inner diameter having a lower column height than the fluid column in the annulus. The difference in fluid column height generates a weight difference sufficient to initiate reverse-circulation upon release of the vapor in the casing inner diameter.

Gas-generating additives may also be injected into the annulus to use the same method to initiate circulation in the conventional direction and to deposit a cement composition in the casing ID for later high-pressure pumping into the annulus.

Optionally, the internal casing ID can be loaded with a fluid containing a gas-generating additive that can generate a gas in situ at a desired time. When included in the present invention, the fluid contained in the casing would react causing gas to be liberated and drive the circulating fluid from the casing, into the annulus at the casing shoe, and out the annulus at the surface. Once the casing fluid has reacted, the gas is then removed or bled from the casing resulting in flow initiation on the annulus. Cement slurry then can enter the annulus and propagate fluid flow the in the reverse mode since heavier density slurry is replacing lighter density circulating fluid. Examples of gas-generating fluids include mixing a high pH water (caustic water) with the addition of azodicarbonamide to generate nitrogen gas. Also, HCl acid may be introduced into lime water to form $CO_2$ in situ. Other gases and/or gas-generating additives also may be suitable for inclusion in the well bore fluids according to the present invention to generate a gas inside the inner diameter of the casing. Exothermic gas liberating reactions that heat the resulting gas by the reaction increase the expansion of the gas so as to further drive fluid from the inner diameter of the casing into the annulus for removal of annular circulating fluid at the well head. Where included, the gas or gas-generating additive may be added to the circulating fluid in a variety of ways, including, but not limited to, dry blending it with the hollow particles, or injecting it into the circulating fluid as a liquid suspension while the circulation fluid is being pumped into the inner diameter of the casing through the well head. In certain exemplary embodiments wherein a gas-generating additive is used, the gas-generating additive may be encapsulated, or may be used in conjunction with an inhibitor, so that the gas-generating additive does not begin to generate a gas until a desired time after placement of the circulation fluid in the inner diameter of the casing.

The timing of gas generation can be controlled by encapsulating the gas generating chemical, for example aluminum, by either encapsulating the material or by addition to the slurry gas generating inhibitors. Examples of such encasulating or gas generating materials include surfactants such as sorbitan monooleate or sorbitan trioleate, mineral oil, waxes and the like. In the case of nitrogen gas generation a combination of two chemicals may be used, one of which is a source of the gas, for example carbohydrazide, toluenesulfonyl hydrazide, and the other chemical is an oxidizer, for example ammonium persulfate and sodium chlorite. In such system, the timing of gas generation may be controlled by encapsulating one of the chemicals, for example the oxidizer. Examples of encapsulating materials include spray-drying of a latex emulsion containing a cross-linker. Such gas generating chemicals are described in U.S. Pat. Nos. 6,722,434 and 6,715,553, incorporated herein by reference.

In an alternative embodiment of the invention, gas-filled balls or spheres are dropped into the casing inner diameter to generate a gas in the circulation fluid filling the inner diameter of the casing. The spheres contain a gas and are weighted to sink in the circulation fluid. When the spheres reach a certain depth, they collapse under the hydrostatic pressure to release the gas. As more and more of the spheres release the gas, the rising gas bubbles displace circulation fluid to reduce the column weight of the gas/fluid mixture in the inner diameter of the casing. The spheres may also be designed to dissolve so as to thereby release the trapped gas. Microspheres, for example, cenospheres available from Halliburton under the trade name SPHERELITE or hollow glass beads such as SCOTCHLITE from 3M Corporation may be used with the present invention. The beads may also be made from a thermoplastic polymer, such as styrene polymer or from a thermoplastic elastomer such as poly(vinyldene chloride). Such beads may contain an organic vapor or a low boiling organic liquid.

Also, gas-filled spheres may similarly be pumped into the annulus to use the same method to initiate circulation in the conventional direction and to deposit a cement composition in the casing ID for later high-pressure pumping into the annulus.

Figure 11:
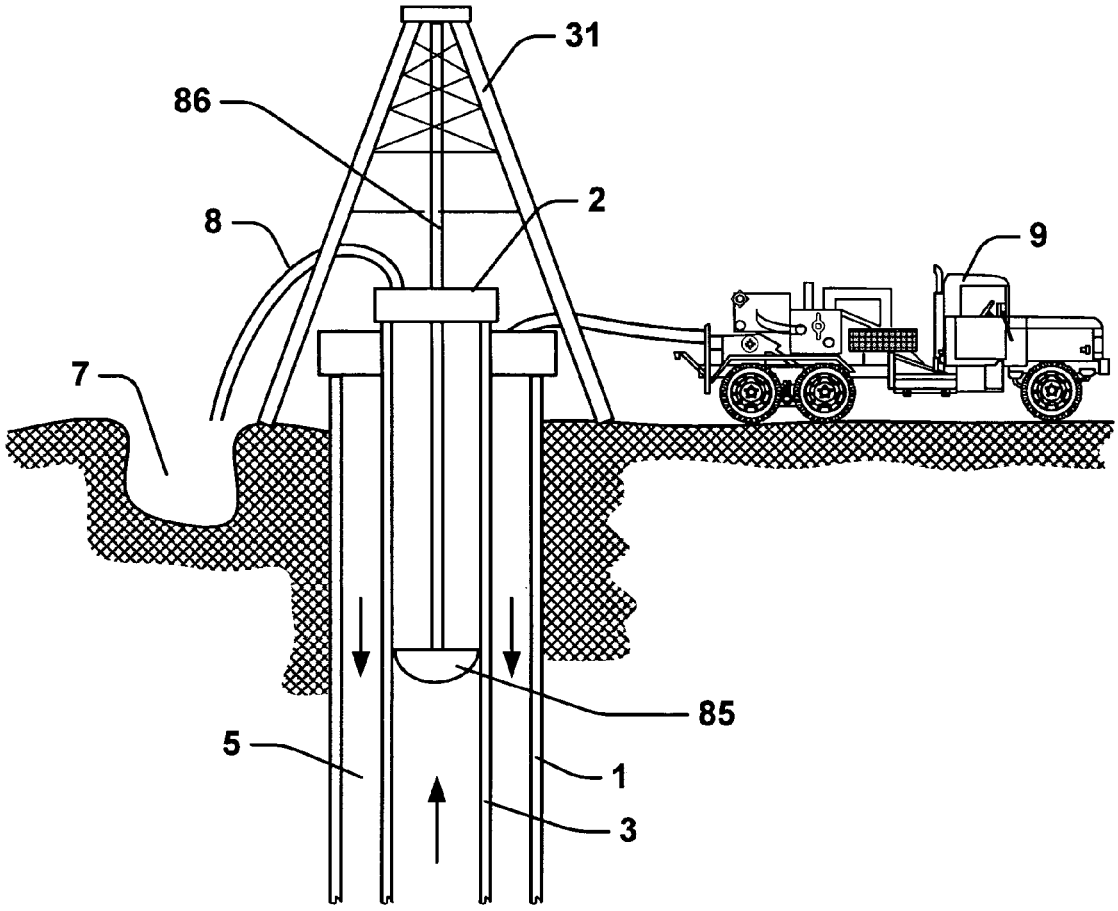
FIG. 11 is a cross-sectional, side view of a well bore having surface casing, cement casing, and a well head, wherein a derrick is positioned over the well bore and a swab is suspended in the inner diameter of the casing from the derrick.

FIG. 11 illustrates a cross-sectional, side view of a well bore and a derrick positioned over the well bore. A surface casing 1 is installed in the well bore. A well head 2 is attached to the surface casing 1 and cement casing 3 is suspended from the well head 2. A pump truck is parked near the well head 2 and is connected directly to the well head to pump cement composition into an annulus 5 through the well head 2. An annulus 5 is defined between the casing 3 and the surface casing 1. A receptacle 7 is positioned to receive returns from the ID of casing 3 via a flow line 8. A swab 85 is suspended in the inner diameter of the casing 3 from the derrick 31 by a pipe string 86.

Fluid flow in the reverse-circulation direction is initiated by pulling the swab 85 out of the casing 3 with the pipe string 86. The swab 85 opens to have a cross-sectional area approximately equal to the inside diameter of the casing. As the swab 85 is lifted, it pulls the circulation fluid toward the top of the casing 3 where it is directed from the well head 2 to the receptacle 7 via the flow line 8. As swab 85 pulls the fluid from the inner diameter of the casing, fluid flow in a reverse-circulation direction is initiated to allow the cement composition to be pumped into the annulus at low pressure.

In another embodiment of the invention, cement composition operations are assumed to begin with the well in a stagnant condition. The casing is suspended in the well bore by the well head, wherein the well head is connected to surface casing. The ID of the casing and the annulus are completely full of stagnant circulation fluid. If a hopper is connected directly to the annulus through the well head, the cement composition will not flow into the annulus due to the gel strength of the circulation fluid. Thus, in this embodiment of the invention, a certain amount of the circulation fluid is removed from the well, either by pumping the circulation fluid from the casing ID or from the annulus. With a certain amount of circulation fluid withdrawn from the well, the fluid level is reduced or lowered below the well head. With no circulation fluid to impede its flow, the cement composition freely flows from the hopper into the annulus and falls in the annulus until it contacts the circulation fluid. As more and more cement composition is flowed into the annulus, the weight of the cement composition pushes the circulation fluid down the annulus and up through the casing ID to initiate circulation in a reverse-circulation direction. An additional amount of the cement composition is flowed into the annulus to maintain circulation and to complete the cementing operation. To initiate fluid flow in the conventional-circulation direction, the cement composition may be flowed into the casing ID rather than the annulus.

The present invention may also be used to deposit cement composition at low pressure in the inner diameter of the casing in a conventional-circulation direction. Returns are taken from the annulus at the well head. Once the cement composition is deposited in the inner diameter of the casing, high pressure pumping equipment may then be attached the inner diameter of the casing through the well head to inject circulation fluid behind the cement composition. The high pressure circulation fluid drives the cement composition down through the inner diameter of the casing and out through the casing shoe and/or circulation valve to the annulus. The high pressure pumps are then used to lift the cement in the annulus to its desired position. Depending on the particular embodiment of the invention, a slow-setting cement composition may be deposited in the inner diameter of the casing by any of the low pressure methods disclosed herein, so that the cement may later be pumped at high pressure from the inner diameter of the casing to the annulus. This invention is particularly applicable where a first operator merely delivers the cement and uses the low pressure pumping equipment disclosed herein to place the cement composition in the inner diameter of the casing and a second operator later uses different high pressure equipment to pump the cement composition into the annulus.

Dry cement may be mixed at the job site with a recirculating cement mixer (RCM) to mix dry cement with water at the job site as the cement is pumped into the annulus. A low-volume mixing hopper that hydrates the cement as it is pumped may also be used. In one embodiment, dry cement is not used, but rather, an extended-set cement or settable fluid is used, such as a cement composition identified as ChannelSeal. This material may be hauled to the job site ahead of time, put into a batch tank, and then pumped into the well bore when ready. In another embodiment, the pump truck may be a vacuum truck, and fluids drawn from the well bore may be mixed with a cement composition at the job site for pumping back into the well bore.

Therefore, the present invention is well adapted to carry out the objects and attain the ends and advantages mentioned as well as those that are inherent therein. While numerous changes may be made by those skilled in the art, such changes are encompassed within the spirit of this invention as defined by the appended claims.

What is claimed is:

1. A method of initiating fluid circulation in a well bore through a casing inner diameter and an annulus outside the casing, the method comprising:

increasing the annulus fluid pressure at the top of the well bore;

flowing a cement composition into the annulus at the top of the well bore;

maintaining a difference in pressure between the fluid pressure of the casing inner diameter and the fluid pressure of the annulus until enough of the cement composition has entered the annulus to drive fluid circulation by the added cement composition weight; and reducing the annulus fluid pressure at the top of the well bore.

2. A method of initiating fluid circulation in a well bore as claimed in claim 1, wherein said increasing the annulus fluid pressure comprises pumping a cement composition into the annulus with an electric pump.

3. A method of initiating fluid circulation in a well bore as claimed in claim 1, wherein said increasing the annulus fluid pressure comprises pumping a cement composition into the annulus with a standpipe.

4. A method of initiating fluid circulation in a well bore as claimed in claim 1, wherein said increasing the annulus fluid pressure comprises pumping a cement composition into the annulus with a rig pump.

5. A method of initiating fluid circulation in a well bore as claimed in claim 1, wherein said increasing the annulus fluid pressure comprises pumping a cement composition into the annulus with a siphon pump.

6. A method of initiating fluid circulation in a well bore through a casing inner diameter and an annulus outside the casing, the method comprising:

decreasing the casing inner diameter fluid pressure by removing fluid from the casing inner diameter;

flowing a cement composition into the annulus at the top of the well bore;

maintaining a difference in pressure between the fluid pressure of the casing inner diameter and the fluid pressure of the annulus until enough of the cement composition has entered the annulus to drive fluid circulation by the added cement composition weight.

7. A method of initiating fluid circulation in a well bore as claimed in claim 6, wherein said decreasing the casing inner diameter fluid pressure comprises pumping circulation fluid out of the casing inner diameter with an electric pump.

8. A method of initiating fluid circulation in a well bore as claimed in claim 6, wherein said decreasing the casing inner diameter fluid pressure comprises pumping circulation fluid out of the casing inner diameter with a Venturi pump.

9. A method of initiating fluid circulation in a well bore as claimed in claim 6, wherein said decreasing the casing inner diameter fluid pressure comprises pumping circulation fluid out of the casing inner diameter with a rig pump.

10. A method of initiating fluid circulation in a well bore as claimed in claim 6, wherein said decreasing the casing inner diameter fluid pressure comprises pulling a swab up through the casing inner diameter.

11. A method of initiating fluid circulation in a well bore through a casing inner diameter and an annulus outside the casing, the method comprising:

depositing a gas within the fluid in the casing inner diameter, whereby a portion of the fluid in the casing inner diameter is displaced by the gas;

flowing a cement composition into the annulus at the top of the well bore;

maintaining a difference in pressure between the fluid pressure of the casing inner diameter and the fluid pressure of the annulus until enough of the cement composition has entered the annulus to drive fluid circulation by the added cement composition weight.

12. A method of initiating fluid circulation in a well bore as claimed in claim 11, wherein said depositing a gas in the fluid in the casing inner diameter comprises injecting gas into the casing inner diameter.

13. A method of initiating fluid circulation in a well bore as claimed in claim 11, wherein said depositing a gas in the fluid in the casing inner diameter comprises injecting pressurized gas into the casing inner diameter to displace circulation fluid from the annulus and releasing the pressurized gas from the casing inner diameter.

14. A method of initiating fluid circulation in a well bore as claimed in claim 11, wherein said depositing a gas in the fluid in the casing inner diameter comprises injecting a fluid into the casing inner diameter, and allowing fluid in the casing inner diameter to vaporize.

15. A method of initiating fluid circulation in a well bore as claimed in claim 11, wherein said depositing a gas in the fluid in the casing inner diameter comprises dropping gas-filled containers into the inner diameter of the casing and releasing the gas from the containers.

16. A method of cementing a casing in a well bore, the method comprising:

connecting a low-pressure cement composition pump to an annulus between the well bore and the casing;

pumping an initial amount of a cement composition at low pressure into the annulus, whereby fluid flow in a reverse-circulation direction through a well bore annulus and the casing inner diameter is initiated;

maintaining fluid flow in a reverse-circulation direction through a well bore annulus and the casing inner diameter until enough of the cement composition has entered the annulus to drive fluid circulation by the added cement composition weight;

disconnecting the low-pressure cement composition pump from the annulus; and flowing an additional amount of the cement composition into the annulus to complete a cement operation.

17. A method of cementing a casing in a well bore as claimed in claim 16, wherein said connecting a low-pressure cement composition pump comprises connecting an electric pump.

18. A method of initiating fluid circulation in a well bore as claimed in claim 16, wherein said connecting a low-pressure cement composition pump comprises connecting a standpipe.

19. A method of initiating fluid circulation in a well bore as claimed in claim 16, wherein said connecting a low-pressure cement composition pump comprises connecting a rig pump.

20. A method of initiating fluid circulation in a well bore as claimed in claim 16, wherein said connecting a low-pressure cement composition pump comprises connecting a siphon pump.

21. A method of cementing a casing in a well bore, wherein an annulus is defined between the casing and the well bore, the method comprising:

connecting a pump to the casing inner diameter;

pumping circulation fluid out of the casing inner diameter, whereby fluid flow in a reverse-circulation direction through the casing inner diameter and annulus is initiated;

flowing an initial amount of a cement composition into the annulus;

maintaining fluid flow in a reverse-circulation direction through a well bore annulus and the casing inner diameter until enough of the cement composition has entered the annulus to drive fluid circulation by the added cement composition weight;

disconnecting the pump from the casing inner diameter; and flowing an additional amount of the cement composition into the annulus to complete a cement operation.

22. A method of cementing a casing in a well bore as claimed in claim 21, wherein said connecting a circulation fluid pump comprises connecting an electric pump.

23. A method of cementing a casing in a well bore as claimed in claim 21, wherein said connecting a circulation fluid pump comprises connecting a Venturi pump.

24. A method of cementing a casing in a well bore as claimed in claim 21, wherein said connecting a circulation fluid pump comprises connecting a rig pump.

25. A well bore cementing system for initiating fluid circulation in a well bore through a casing inner diameter and an annulus outside the casing, the system comprising:

a low-pressure cement composition pump fluidly connected to the annulus, wherein the low-pressure cement composition pump is operable to initiate reverse-circulation fluid flow in the well bore; and a cement composition container fluidly connected to the annulus, wherein a cement composition is flowable from the container into the annulus once reverse-circulation fluid flow has been established.

26. A well bore cementing system for initiating fluid circulation in a well bore as claimed in claim 25, wherein said low-pressure cement composition pump comprises an electric pump.

27. A well bore cementing system for initiating fluid circulation in a well bore as claimed in claim 25, wherein said low-pressure cement composition pump comprises a standpipe.

28. A well bore cementing system for initiating fluid circulation in a well bore as claimed in claim 25, wherein said low-pressure cement composition pump comprises a rig pump.

29. A well bore cementing system for initiating fluid circulation in a well bore as claimed in claim 25, wherein said low-pressure cement composition pump comprises a siphon pump.

30. A well bore cementing system for initiating fluid circulation in a well bore through a casing inner diameter and an annulus outside the casing, the system comprising:

a low-pressure pump fluidly connected to the casing inner diameter, wherein the low-pressure pump is operable to remove fluid from the casing inner diameter to initiate reverse-circulation fluid flow in the well bore; and a cement composition container fluidly connected to the annulus, wherein a cement composition is flowable from the container into the annulus once reverse-circulation fluid flow has been established.

31. A well bore cementing system for initiating fluid circulation in a well bore as claimed in claim 30, wherein said low-pressure pump fluidly connected to the casing inner diameter comprises an electric pump.

32. A well bore cementing system for initiating fluid circulation in a well bore as claimed in claim 30, wherein said low-pressure pump fluidly connected to the casing inner diameter comprises a Venturi pump.

33. A well bore cementing system for initiating fluid circulation in a well bore as claimed in claim 30, wherein said low-pressure pump fluidly connected to the casing inner diameter comprises a rig pump.

34. A well bore cementing system for initiating fluid circulation in a well bore as claimed in claim 30, wherein said low-pressure pump fluidly connected to the casing inner diameter comprises a swab inserted in the casing inner diameter.

35. A well bore cementing system for initiating fluid circulation in a well bore through a casing inner diameter and an annulus outside the casing, the system comprising:

a gas-introduction device fluidly connected to the casing inner diameter, wherein the gas-introduction device is operable to introduce gas in the casing inner diameter to initiate reverse-circulation fluid flow in the well bore; and a cement composition container fluidly connected to the annulus, wherein a cement composition is flowable from the container into the annulus once reverse-circulation fluid flow has been established.

36. A well bore cementing system for initiating fluid circulation in a well bore as claimed in claim 35, wherein said gas-introduction device comprises a gas injector that injects gas into the casing inner diameter and mixes the injected gas with fluid in the casing inner diameter.

37. A well bore cementing system for initiating fluid circulation in a well bore as claimed in claim 35, wherein said gas-introduction device comprises a high-pressure gas injector that injects pressurized gas into the casing inner diameter to displace circulation fluid from the annulus and further comprises a pressure relief valve.

38. A well bore cementing system for initiating fluid circulation in a well bore as claimed in claim 35, wherein said gas-introduction device comprises a fluid injector that injects a vaporizing fluid into the casing inner diameter, whereby fluid in the casing inner diameter vaporizes.

39. A method of cementing a casing in a well bore, the method comprising:

connecting a low-pressure cement composition pump to the casing inner diameter;

pumping an initial amount of a cement composition at low pressure into the casing inner diameter, whereby fluid flow in a conventional-circulation direction through a well bore annulus and the casing inner diameter is initiated;

maintaining fluid flow in a conventional-circulation direction through a well bore annulus and the casing inner diameter until enough of the cement composition has entered the casing inner diameter to drive fluid circulation by the added cement composition weight;

disconnecting the low-pressure cement composition pump from the casing inner diameter;

flowing an additional amount of the cement composition into the casing inner diameter;

connecting a high-pressure pump to the casing inner diameter; and pumping at a relatively higher fluid pressure the cement composition from the casing inner diameter into the annulus through a lower end of the casing.

40. A method of cementing a casing in a well bore as claimed in claim 39, wherein said connecting a low-pressure cement composition pump comprises connecting an electric pump.

41. A method of initiating fluid circulation in a well bore as claimed in claim 39, wherein said connecting a low-pressure cement composition pump comprises connecting a standpipe.

42. A method of initiating fluid circulation in a well bore as claimed in claim 39, wherein said connecting a low-pressure cement composition pump comprises connecting a rig pump.

43. A method of initiating fluid circulation in a well bore as claimed in claim 39, wherein said connecting a low-pressure cement composition pump comprises connecting a siphon pump.

44. A method of cementing a casing in a well bore, wherein an annulus is defined between the casing and the well bore, the method comprising:

connecting a pump to the annulus;

pumping circulation fluid out of the annulus, whereby fluid flow in a conventional-circulation direction through the casing inner diameter and annulus is initiated;

flowing an initial amount of a cement composition into the casing inner diameter;

maintaining fluid flow in a conventional-circulation direction through a well bore annulus and the casing inner diameter until enough of the cement composition has entered the casing inner diameter to drive fluid circulation by the added cement composition weight;

disconnecting the pump from the annulus;

flowing an additional amount of the cement composition into the casing inner diameter;

connecting a relatively higher pressure pump to the casing inner diameter; and pumping at a relatively higher fluid pressure the cement composition from the casing inner diameter into the annulus through a lower end of the casing.

45. A method of cementing a casing in a well bore as claimed in claim 44, wherein said connecting a circulation fluid pump comprises connecting an electric pump.

46. A method of cementing a casing in a well bore as claimed in claim 44, wherein said connecting a circulation fluid pump comprises connecting a Venturi pump.

47. A method of cementing a casing in a well bore as claimed in claim 44, wherein said connecting a circulation fluid pump comprises connecting a rig pump.

48. A well bore cementing system for cementing a casing in the well bore, the system comprising:

a low-pressure cement composition pump fluidly connected to the casing inner diameter, wherein the low-pressure cement composition pump is operable to initiate conventional-circulation fluid flow in the well bore;

a cement composition container fluidly connected to the casing inner diameter, wherein a cement composition is flowable from the container into the casing inner diameter once conventional-circulation fluid flow has been established; and a high-pressure pump fluidly connected to the casing inner diameter, wherein the high-pressure pump is operable to pump cement composition from casing inner diameter into the annulus through a lower end of the casing.

49. A well bore cementing system for initiating fluid circulation in a well bore as claimed in claim 48, wherein said low-pressure cement composition pump comprises an electric pump.

50. A well bore cementing system for initiating fluid circulation in a well bore as claimed in claim 48, wherein said low-pressure cement composition pump comprises a standpipe.

51. A well bore cementing system for initiating fluid circulation in a well bore as claimed in claim 48, wherein said low-pressure cement composition pump comprises a rig pump.

52. A well bore cementing system for initiating fluid circulation in a well bore as claimed in claim 48, wherein said low-pressure cement composition pump comprises a siphon pump.

53. A well bore cementing system for initiating fluid circulation in a well bore through a casing inner diameter and an annulus outside the casing and for cementing the casing, the system comprising:

a low-pressure pump fluidly connected to the annulus, wherein the low-pressure pump is operable to remove fluid from the annulus to initiate conventional-circulation fluid flow in the well bore;

a cement composition container fluidly connected to the casing inner diameter, wherein a cement composition is flowable from the container into the casing inner diameter once conventional-circulation fluid flow has been established; and a high-pressure pump fluidly connected to the casing inner diameter, wherein the high-pressure pump is operable to pump cement composition from casing inner diameter into the annulus through a lower end of the casing.

54. A well bore cementing system for initiating fluid circulation in a well bore as claimed in claim 53, wherein said low-pressure pump fluidly connected to the annulus comprises an electric pump.

55. A well bore cementing system for initiating fluid circulation in a well bore as claimed in claim 53, wherein said low-pressure pump fluidly connected to the annulus comprises a Venturi pump.

56. A well bore cementing system for initiating fluid circulation in a well bore as claimed in claim 53, wherein said low-pressure pump fluidly connected to the annulus comprises a rig pump.

57. A well bore cementing system for initiating fluid circulation in a well bore through a casing inner diameter and an annulus outside the casing and for cementing the casing, the system comprising:

a gas introducing device fluidly connected to the annulus, wherein the gas inducing device is operable to introduce gas in the annulus to initiate conventional-circulation fluid flow in the well bore;

a cement composition container fluidly connected to the casing inner diameter, wherein a cement composition is flowable from the container into the casing inner diameter once conventional-circulation fluid flow has been established; and a high-pressure pump fluidly connected to the casing inner diameter, wherein the high-pressure pump is operable to pump cement composition from casing inner diameter into the annulus through a lower end of the casing.

58. A well bore cementing system for initiating fluid circulation in a well bore as claimed in claim 57, wherein said gas introduction device comprises a gas injector that injects gas into the annulus and mixes the injected gas with fluid in the annulus.

59. A well bore cementing system for initiating fluid circulation in a well bore as claimed in claim 57, wherein said gas introduction device comprises a high-pressure gas injector that injects pressurized gas into the annulus to displace circulation fluid from the casing inner diameter and further comprises a pressure relief valve.

60. A well bore cementing system for initiating fluid circulation in a well bore as claimed in claim 57, wherein said gas introduction device comprises a fluid injector that injects a vaporizing fluid into the annulus, whereby fluid in the annulus vaporizes.

* * * * *